US008851251B2

(12) United States Patent
Sener et al.

(10) Patent No.: US 8,851,251 B2
(45) Date of Patent: Oct. 7, 2014

(54) HANDLE FOR LUGGAGE

(71) Applicant: Travelpro International Inc., Boca Raton, FL (US)

(72) Inventors: James T. Sener, Glastonbury, CT (US); Christopher D. Hageman, South Glastonbury, CT (US); David L. Mathieu, Colchester, CT (US); Scott Smith, Hartford, CT (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 13/871,488

(22) Filed: Apr. 26, 2013

(65) Prior Publication Data

US 2013/0233662 A1 Sep. 12, 2013

Related U.S. Application Data

(63) Continuation of application No. PCT/US2011/057207, filed on Oct. 21, 2011.

(60) Provisional application No. 61/407,971, filed on Oct. 29, 2010.

(51) Int. Cl.

| | |
|---|---|
| ***A45C 13/02*** | (2006.01) |
| ***A45C 13/26*** | (2006.01) |
| *A45C 5/14* | (2006.01) |
| *A45C 13/28* | (2006.01) |

(52) U.S. Cl.

CPC ..... *A45C 13/262* (2013.01); *A45C 5/145* (2013.01); *A45C 5/14* (2013.01); *A45C 13/28* (2013.01); *A45C 2013/265* (2013.01)

USPC ..... 190/115; 280/655.1; 190/18 A; 16/411; 16/113.1

(58) Field of Classification Search

CPC ..... A45C 13/262; A45C 5/14

USPC ..... 190/18 A, 115; 280/655.1; 16/113.1, 16/405, 411, DIG. 12

See application file for complete search history.

(56) References Cited

U.S. PATENT DOCUMENTS 3,813,729 A * 6/1974 Szabo et al. ..... 16/408
4,118,048 A * 10/1978 Spranger et al. ..... 280/47.35

(Continued)

FOREIGN PATENT DOCUMENTS

CN 2440362 Y 8/2001
CN 1622773 A 6/2005

(Continued)

OTHER PUBLICATIONS

Evaluation Report of Utility Model Patent, State Intellectual Property Office of the People's Republic of China, Mailing Date May 30, 2013, 7 pages.

(Continued)

*Primary Examiner* — Sue A Weaver
(74) *Attorney, Agent, or Firm* — Reising Ethington P.C.

(57) ABSTRACT

An ergonomic handle for luggage is provided. In one aspect, the handle comprises at least one palm grip. The handle is attached to a compartment with wheels. The palm grip can be used to push the luggage as the wheels roll over a rolling surface.

18 Claims, 36 Drawing Sheets

(56) References Cited

U.S. PATENT DOCUMENTS

| | | | | | |
|---|---|---|---|---|---|
| 4,561,526 | A | * | 12/1985 | Winter et al. | 190/115 |
| 4,989,511 | A | | 2/1991 | Clarke, Jr. | |
| 5,377,795 | A | * | 1/1995 | Berman | 190/18 A |
| 5,452,778 | A | | 9/1995 | Wang | |
| 5,630,250 | A | * | 5/1997 | Chou | 16/113.1 |
| 5,669,103 | A | * | 9/1997 | Hui | 16/113.1 |
| 5,762,168 | A | | 6/1998 | Miyoshi | |
| 5,782,325 | A | | 7/1998 | O'Shea et al. | |
| 5,890,570 | A | * | 4/1999 | Sadow | 190/18 A |
| 5,914,425 | A | * | 6/1999 | Meisel et al. | 560/27 |
| 5,964,451 | A | | 10/1999 | Sudheimer | |
| 6,065,574 | A | | 5/2000 | Miyoshi | |
| 6,193,033 | B1 | * | 2/2001 | Sadow et al. | 190/18 A |
| 6,301,746 | B1 | * | 10/2001 | Myers et al. | 16/113.1 |
| 6,434,790 | B1 | | 8/2002 | Chen | |
| 7,188,715 | B1 | * | 3/2007 | Chen | 190/115 |
| 7,438,308 | B2 | * | 10/2008 | Kim et al. | 280/655.1 |
| 7,461,730 | B2 | | 12/2008 | Costa et al. | |
| 7,467,696 | B2 | | 12/2008 | Wu | |
| D591,511 | S | | 5/2009 | Wu | |
| D637,398 | S | | 5/2011 | Jiang | |
| D648,132 | S | | 11/2011 | Wu | |
| D651,803 | S | | 1/2012 | Wu | |
| 2002/0014382 | A1 | * | 2/2002 | Kuo | 190/115 |
| 2002/0024189 | A1 | * | 2/2002 | Chen | 280/79.2 |
| 2003/0079950 | A1 | * | 5/2003 | Lin et al. | 190/115 |
| 2005/0258621 | A1 | * | 11/2005 | Johnson et al. | 280/651 |
| 2006/0031994 | A1 | | 2/2006 | Willat et al. | |
| 2007/0158159 | A1 | * | 7/2007 | Burgess | 190/115 |
| 2007/0266527 | A1 | * | 11/2007 | Chen | 16/431 |
| 2008/0083592 | A1 | * | 4/2008 | Mangano | 190/110 |
| 2008/0308370 | A1 | | 12/2008 | Chung et al. | |
| 2009/0139814 | A1 | | 6/2009 | Grossman et al. | |
| 2011/0088987 | A1 | * | 4/2011 | Santy et al. | 190/115 |
| 2011/0168507 | A1 | * | 7/2011 | Penley et al. | 190/18 A |

FOREIGN PATENT DOCUMENTS

| | | | |
|---|---|---|---|
| CN | 2825016 | Y | 10/2006 |
| CN | 2894387 | Y | 5/2007 |
| CN | 201451800 | U | 5/2010 |
| WO | WO 03063637 | A2 * | 8/2003 |

OTHER PUBLICATIONS

Comfort Grip Luggage Handle Extender, http://www.flightattendantshop.com/product/detail,cfm/nid/6/pid/267, Oct. 14, 2010, 1 page.

Thumb Pad on a Cup, http://www.promotional-gifts-inc.com/custom-wholesale/Drinkware-Mugs/Spruzzo-15oz-Plastic-Mug-with-Steel-Interior-Handle-6253.htm, Oct. 14, 2010, 1 page.

Werks Traveler 20" Deluxe Wheeled Travel Bag, http://www.wellpromo.com/upload/upimg60/Werks-Traveler-20-Deluxe-Whee-151660.jpg, Oct. 14, 2010, 1 page.

* cited by examiner

62c

HANDLE FOR LUGGAGE

FIELD

The present specification relates generally to luggage and more specifically relates to handles for luggage.

BACKGROUND

Travel is a common human activity and luggage is an important feature of travel. When it comes to air travel, the demands on luggage can be particularly intense.

BRIEF DESCRIPTION OF THE DRAWINGS

Reference will now be made, by way of example only, to the accompanying drawings in which.

DETAILED DESCRIPTION

As used herein, any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components may in practice be utilized in orientations that are the same as, or different than those, described or shown.

Figure 1:
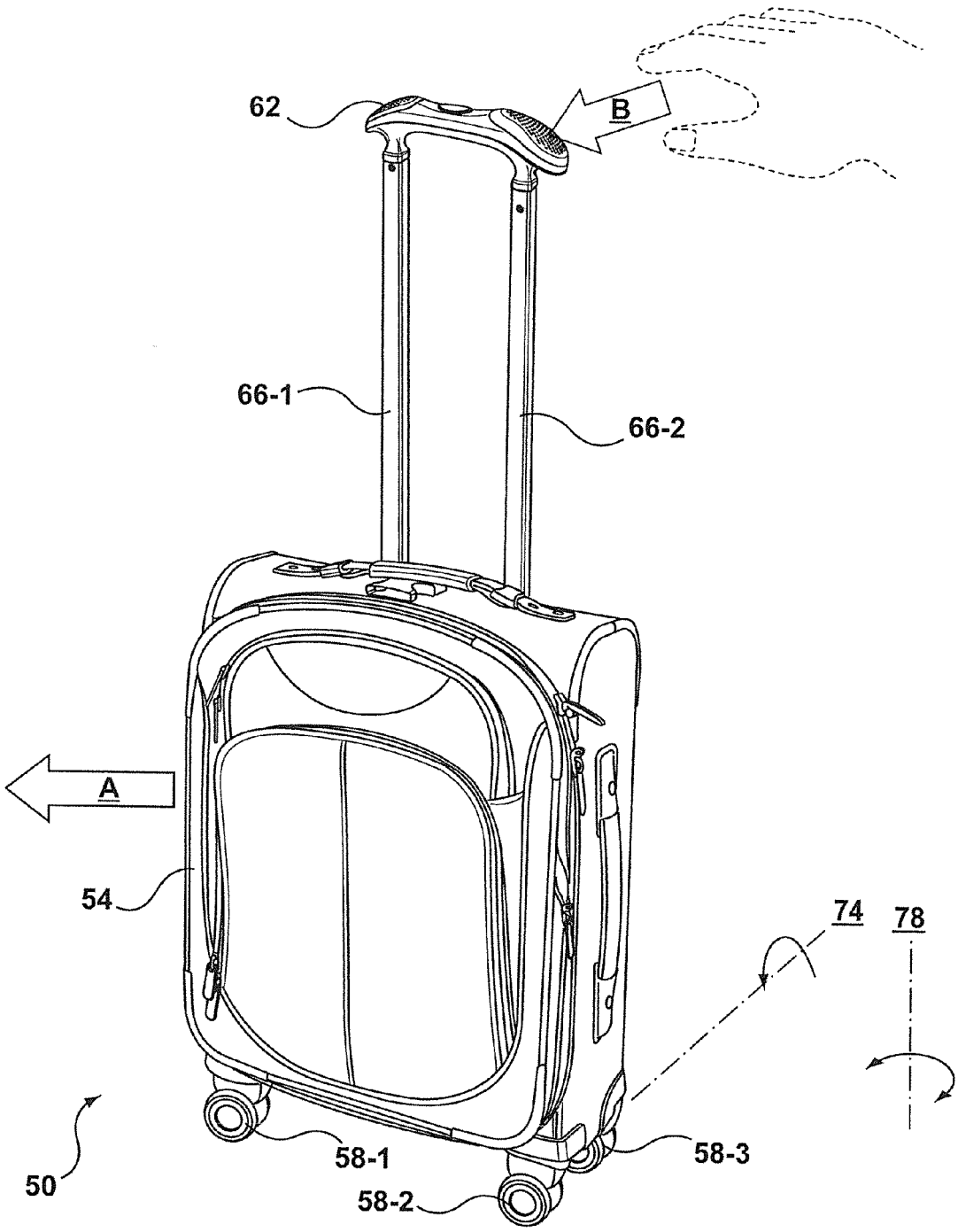
FIG. 1 is a perspective view of an article of luggage being pushed in a first direction.
Figure 2:
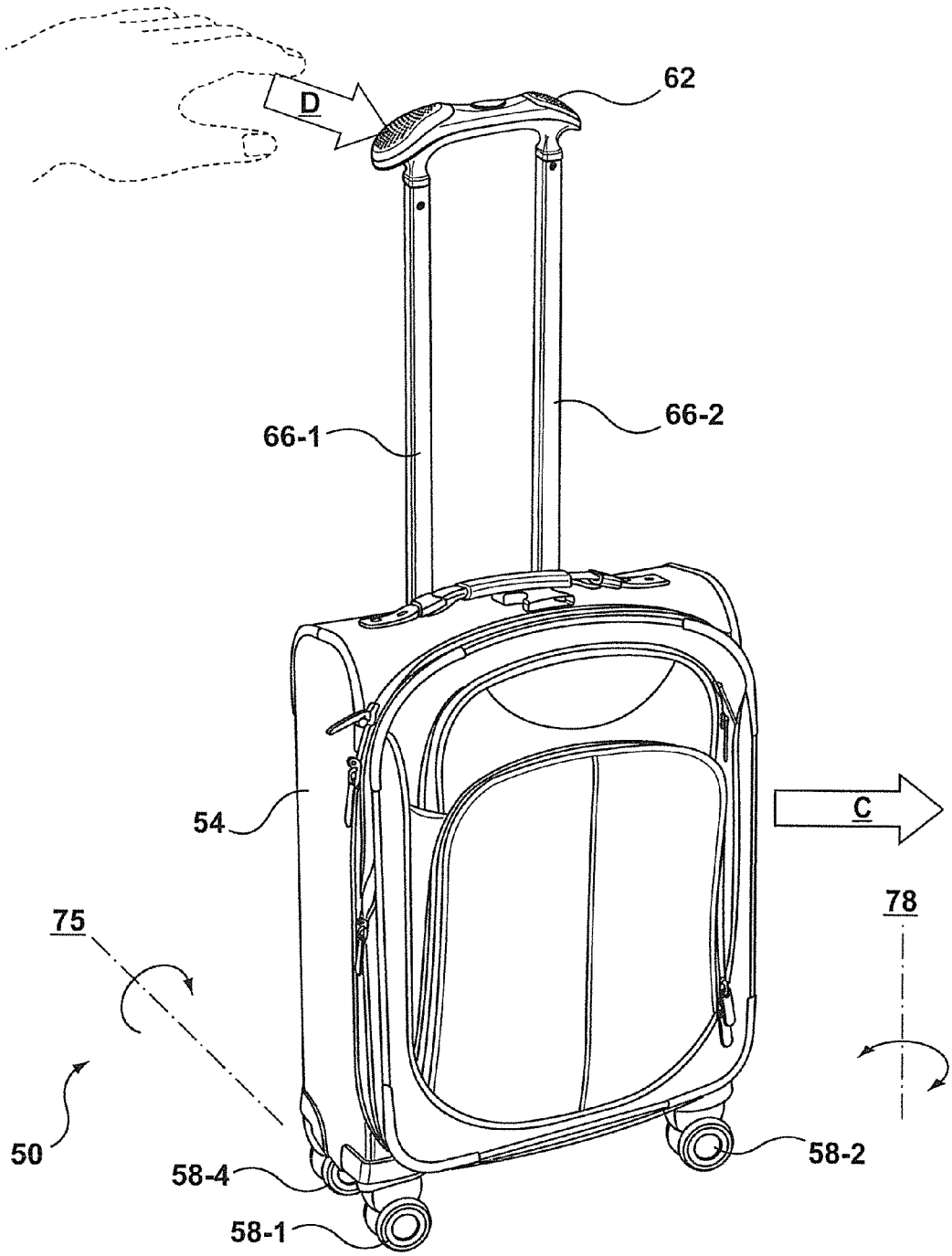
FIG. 2 shows the article of luggage from FIG. 1 being pushed in the opposite direction shown in FIG. 1.

Referring now to FIG. 1 and FIG. 2, an article of luggage is indicated generally at 50. In a non-limiting example embodiment, luggage 50 comprises a compartment 54 for storing and transporting personal effects or other articles. Luggage 50 also comprises a plurality of wheels plurality of wheels 58-1, 58-2, 58-3 and 58-4. (Collectively, wheels 58, and generically, wheel 58. This nomenclature is used elsewhere herein.) Wheels 58 are mounted to compartment 54, and can be used to roll luggage 50 along a substantially smooth surface.

Figure 3:
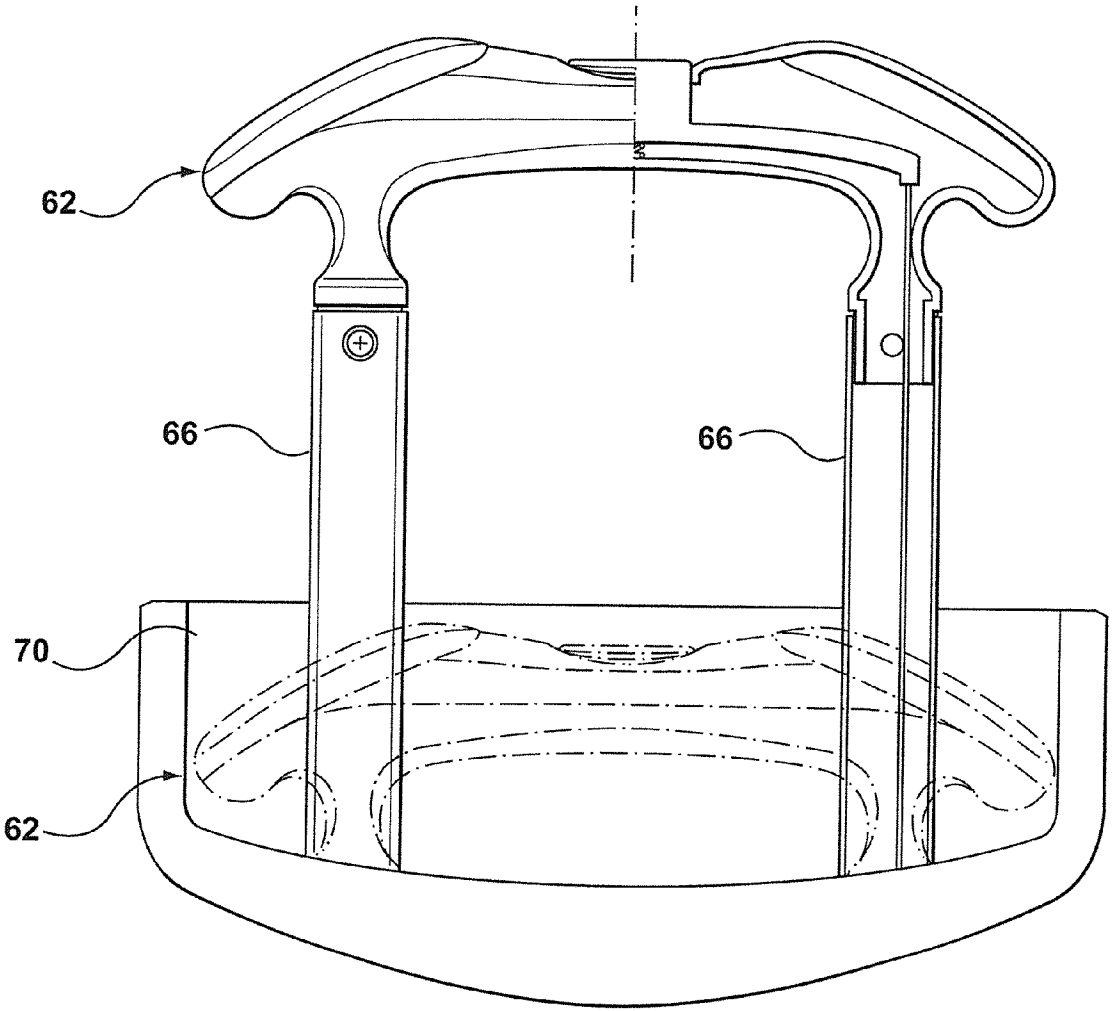
FIG. 3 is shows the handle and rods of the luggage of FIG. 1 and FIG. 2 in an extended and retracted position.
Figure 4:
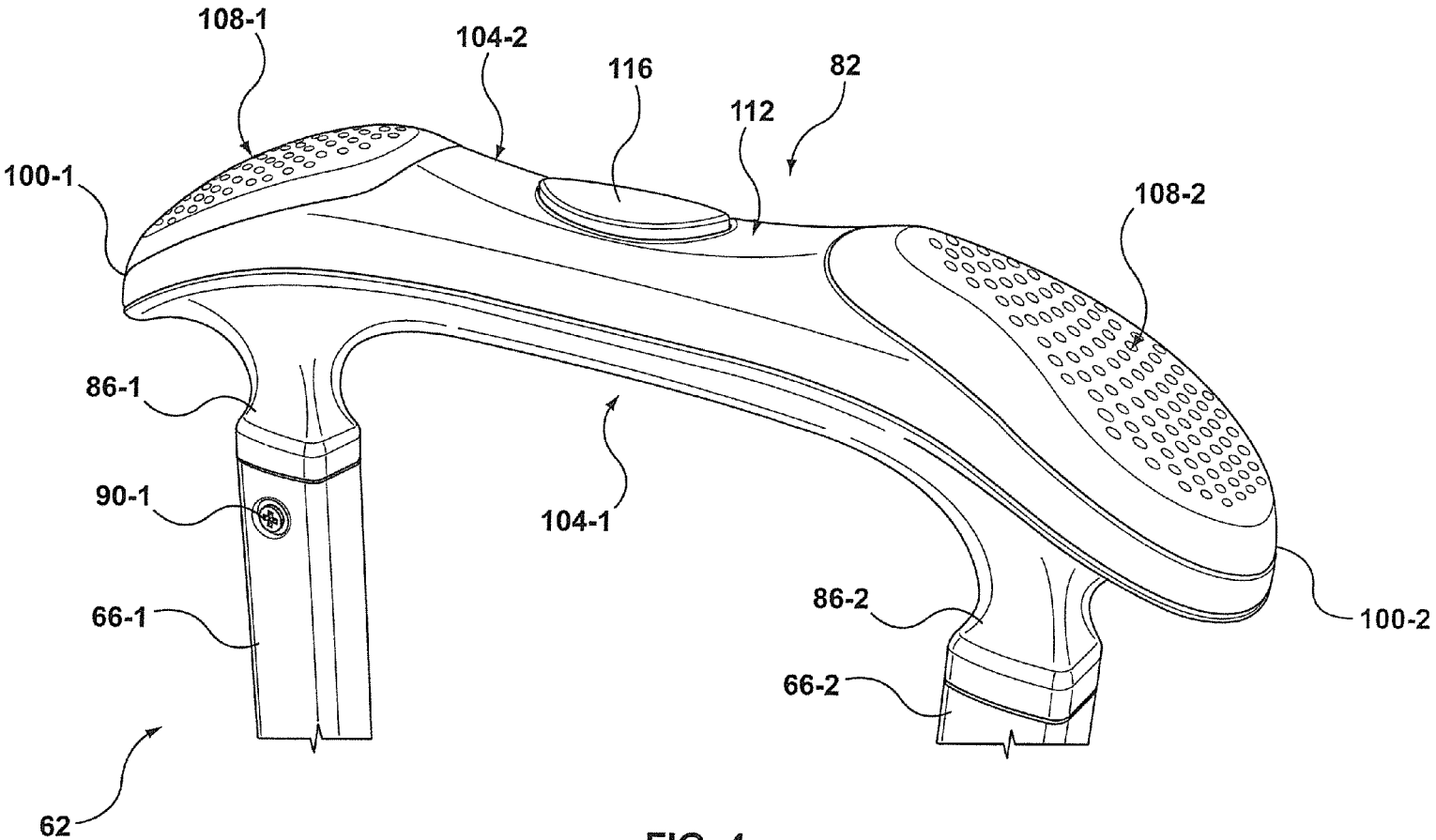
FIG. 4 shows a perspective view of the handle of FIG. 1.

Luggage 50 also comprises a handle 62 that connects to compartment 54 via a pair of retractable rods 66. In FIG. 1 and FIG. 2, rods 66 are in a fully extended position so that handle 62 is brought within an arm's reach while a person is standing substantially upright. As seen in FIG. 3, rods 66 are movable between the extended position in FIG. 1 and FIG. 2 to a retracted position within a recessed chamber 70 disposed within a side of compartment 54 that is opposite from the side of compartment 54 to which wheels 58 are mounted.

Referring again to FIG. 1 and FIG. 2, in a present embodiment, compartment 54 which can be opened to receive or remove articles, and can be closed for storage or transportation. It is to be understood that the nature of compartment 54 is not particularly limited, and that variations on the configuration of the compartment 54 shown in Figure are contemplated. For example, compartment 54 can be of a hard material (e.g. plastic or metal) or a soft material (e.g. fabric). Compartment 54 can also have different configurations, including a split configuration comprising two equal size halves or non-equal size halves. Compartment 54 can be a backpack, dufflebag, or briefcase. Compartment 54 can also be configured to open from one or more different sides, and the means by which it is opened is not particularly limited. Likewise the configuration, orientation and type of hinging mechanism are not particularly limited. A variety of other types of compartments will now occur to those skilled in the art.

In a present embodiment, four wheels 58 are provided. As seen in FIG. 1 each wheel can rotate along a rotational axis 74 that is substantially parallel to a rolling surface so that luggage 50 can be rolled in direction "A" in reaction to a force applied along direction "B" to handle 62. Wheels 58 are also configured to spin along an axis 78 that is perpendicular to the rolling surface, to thereby change the orientation of rotational axis 74 so that luggage 50 can be rolled in any direction along rolling surface. To illustrate this point, in FIG. 2 luggage 50 is shown as being moved in direction "C" (opposite to direction "A" in FIG. 1) in reaction to force applied along direction "D" to the opposite side of handle 62, such that wheels 58 rotate along rotational axis 75. It is to be understood that the number and nature of wheels 58 is also not particularly limited. For example, fewer or more wheels can be provided. In other configurations, one or more of the wheels may be configured to spin, or not, along axis 78.

Figure 8:
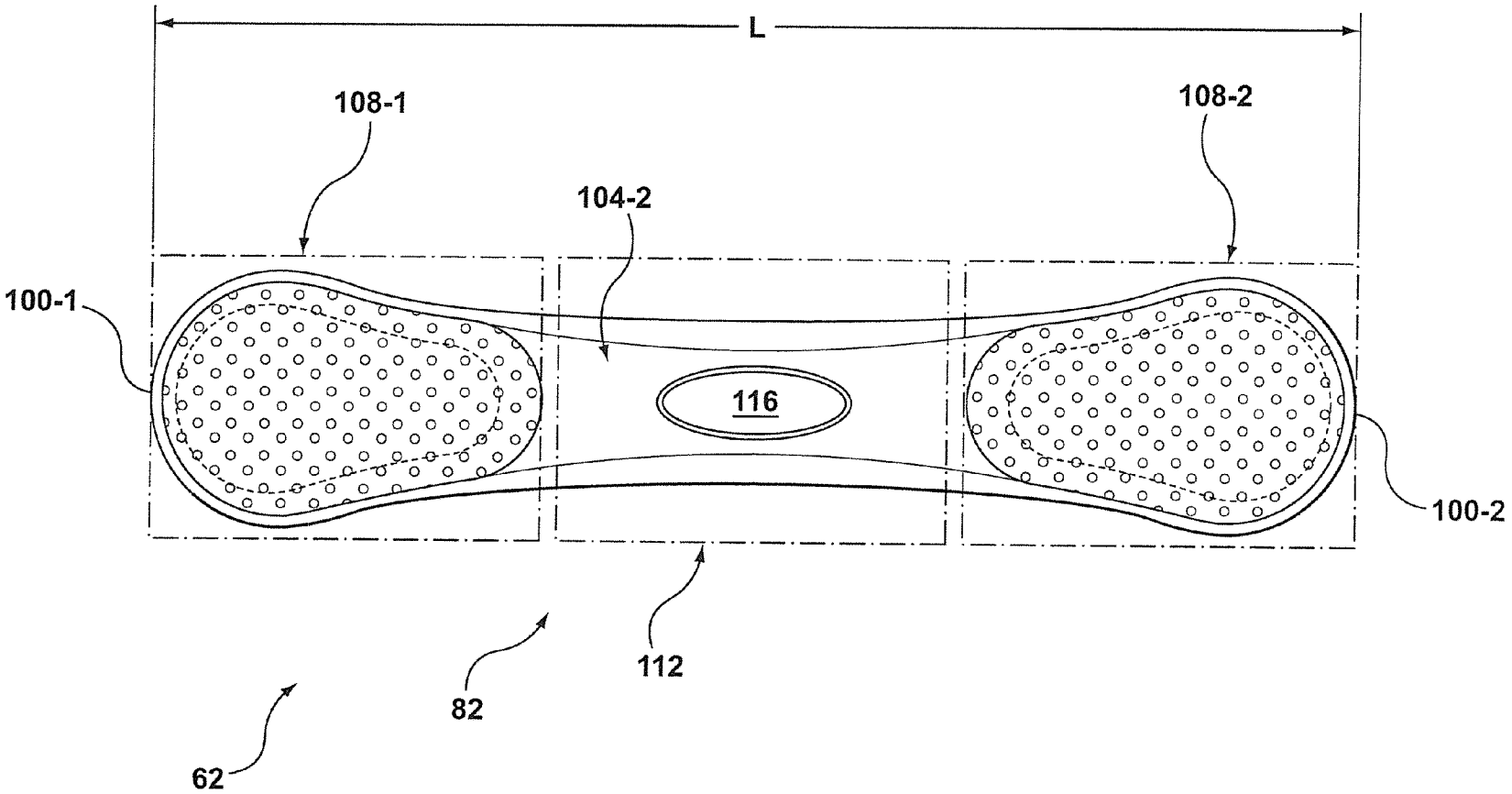
FIG. 8 shows a top planar view of the handle of FIG. 1.
Figure 9:
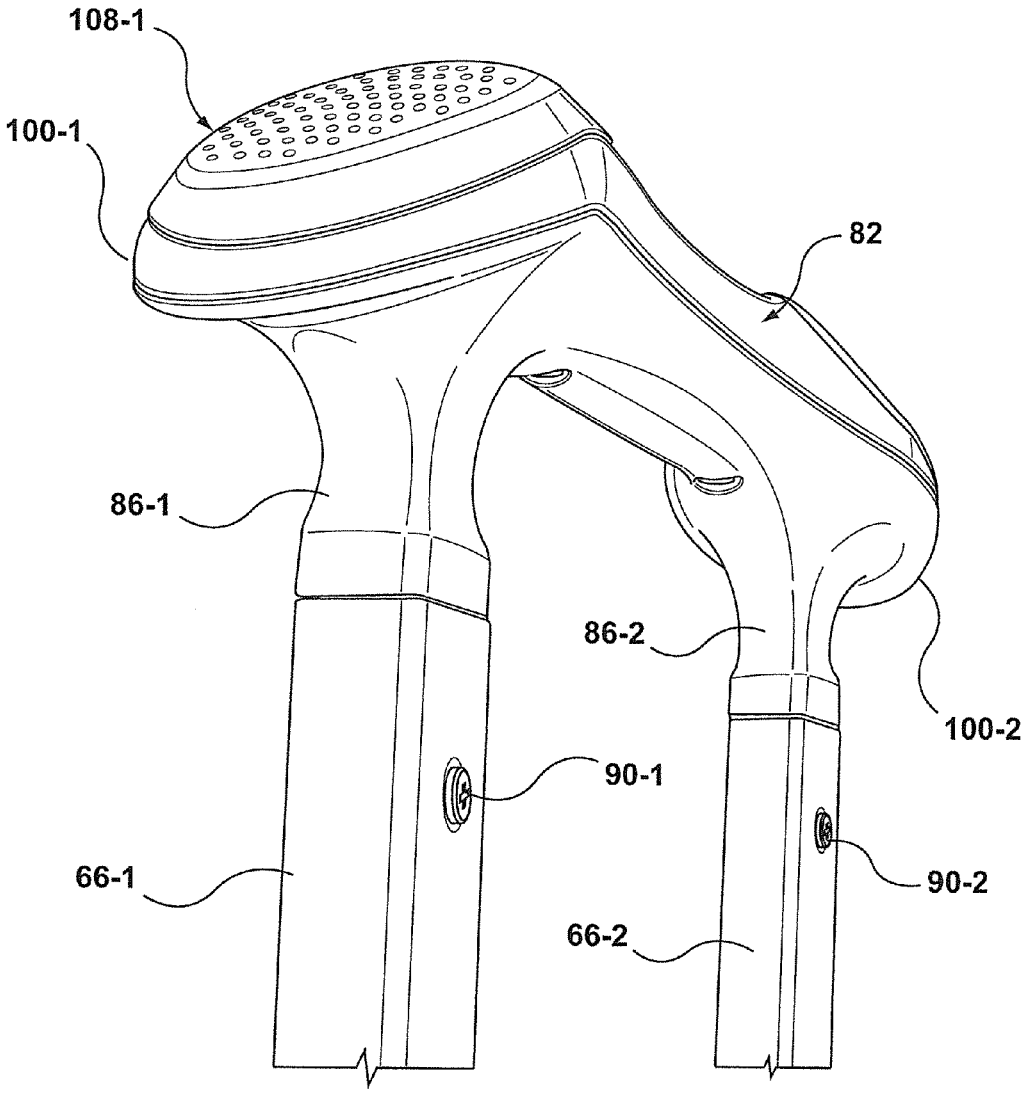
FIG. 9 shows a bottom-left perspective view of the handle of FIG. 1.
Figure 10:
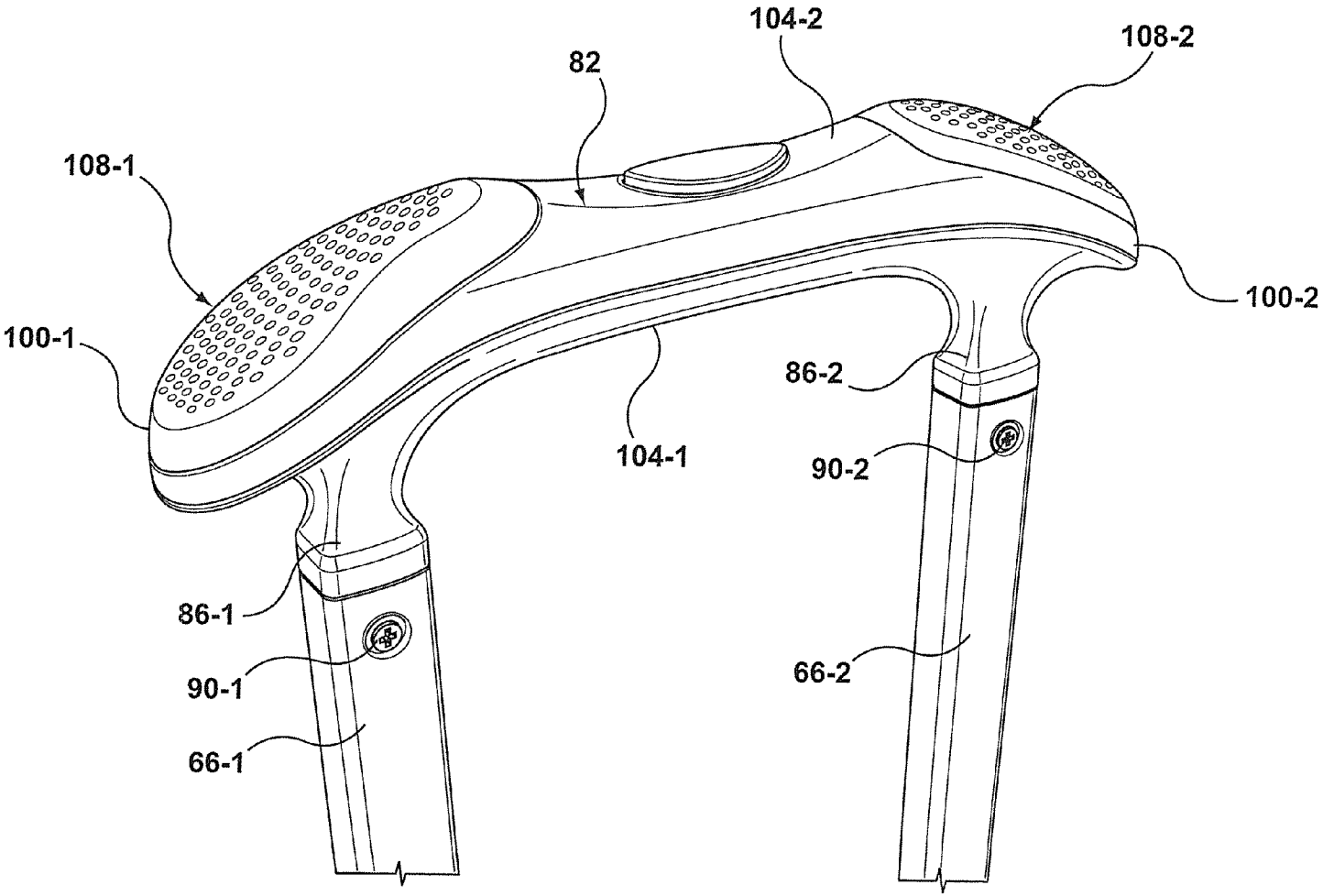
FIG. 10 shows a top-left perspective view of the handle of FIG. 1.
Figure 11:
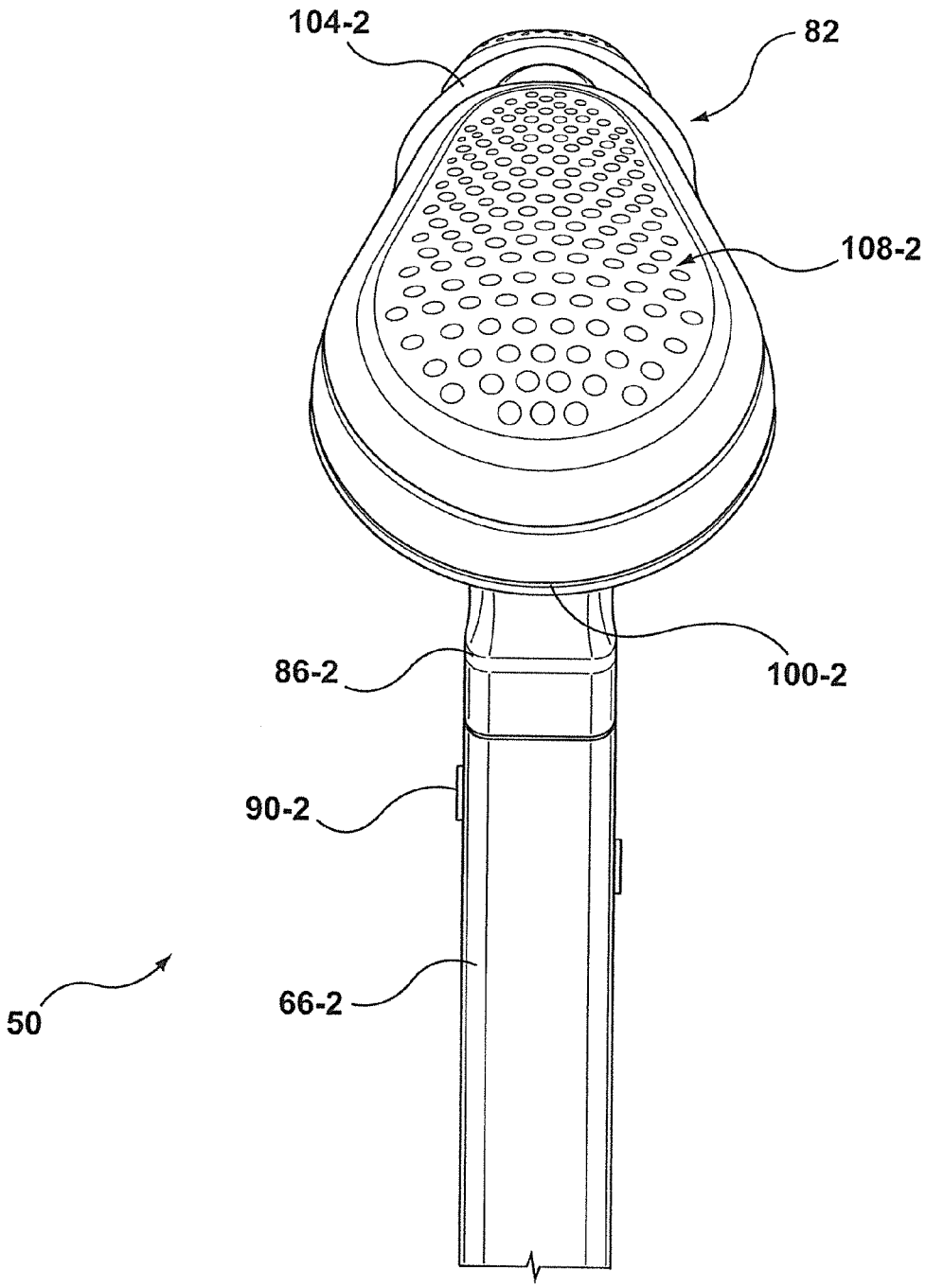
FIG. 11 shows a right view of the handle of FIG. 1.
Figure 12:
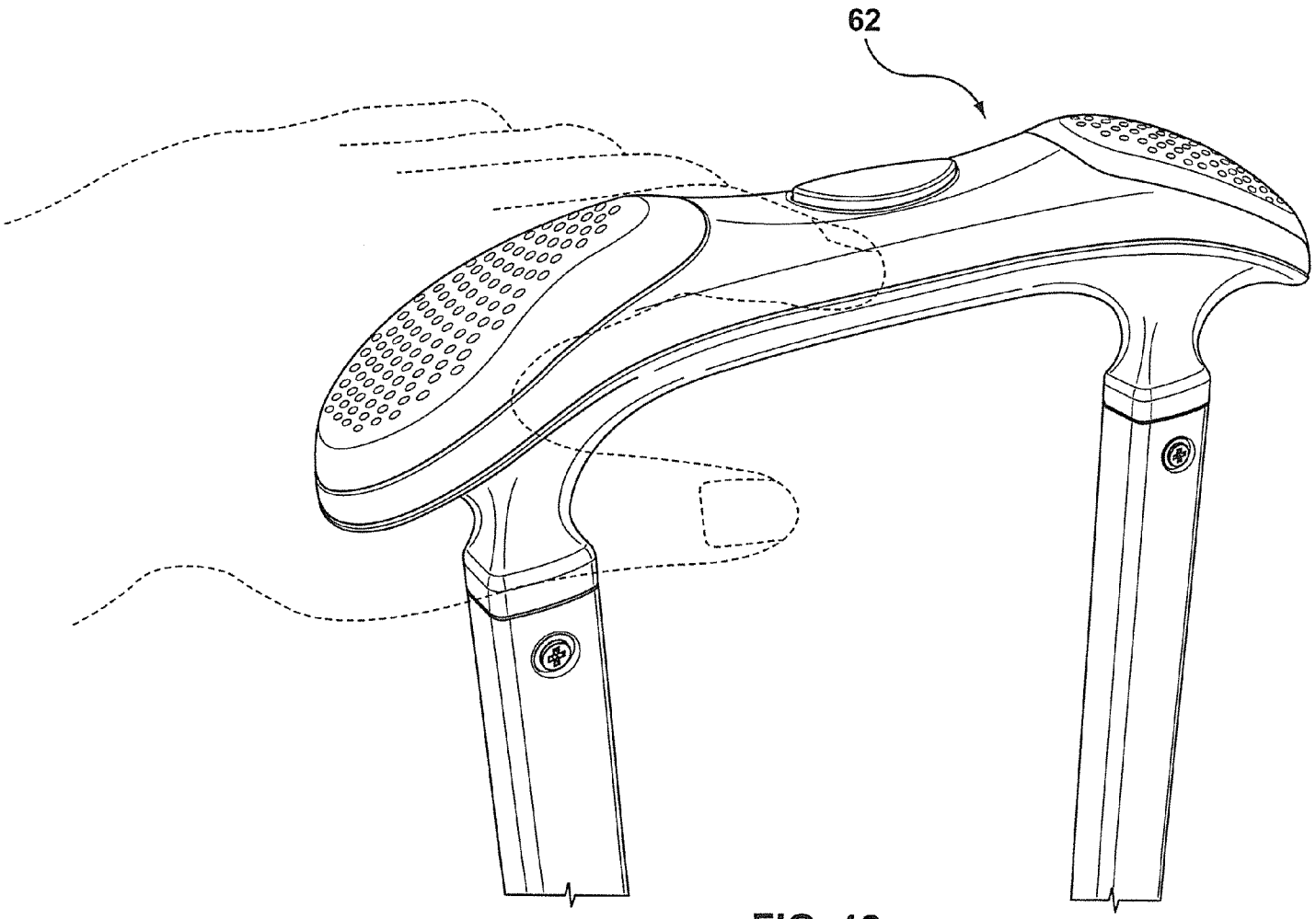
FIG. 12 shows the same view as FIG. 10 but with an outline of a human hand engaging with the handle.

Referring now to FIGS. 4-11, handle 62 is shown in greater detail. Handle 62 thus comprises a body 82. Body 82 has a first end 100-1 opposite to a second end 100-2 and a proximal edge 104-1 and opposite to a distal edge 104-2. As best seen in FIG. 8, edges 104 define a length L of body 82 between each end 100.

Proximal edge 104-1 includes a pair of rod-junctions 86. In a present embodiment, each rod-junction 86 is implemented as a strut received within a hollow end of a distal end of a respective rod 66 and mechanically fastened thereto by a screw 90. Other configurations for attaching body 82 to rods 66 are contemplated.

Distal edge 104-2 includes a pair of palm grips 108. First palm grip 108-1 is situated at first end 100-1, and second palm grip 108-2 is situated at second end 100-2. A central grip 112 is disposed between each palm-grip 108. While palms grips 108 and central grip 112 are labeled in various Figures, FIG. 8 uses hashed-boxes to more specifically illustrate which portions of body 82 correspond to palms grips 108 and central grip 112. From the view in FIG. 5, it can be seen that palm grips 108 are substantially convex while central grip 112 is substantially concave.

Each palm grip 108 has a shape that complements the palm (or metacarpus) of a human hand, in order to distribute a force across a corresponding area of the palm. In a present embodiment, each palm grip 108 is rounded to further distribute force across the palm. Each palm grip 108 is also substantially tear-drop shaped having wider bulbous portion proximal to its respective end 100 and a narrow bulbous portion proximal central grip 112. While body 82 is made from a substantially non-deformable material, such as a hard plastic, each palm grip 108 is made from a resiliently-deformable material, such as a foamed plastic, which is affixed to body 82 via a glue or other fastening means. The deformable nature of each palm grip 108 further improves the distribution of force across the area of the palm (or other entity that applies the force) that comes into contact with the palm grip 108.

In a present embodiment the surface of each palm grip 108 is dimpled to increase the level of friction between the palm and the surface of the palm grip 108, and reduce the likelihood of the palm slipping from the palm grip 108 while luggage 50 is being pushed. Other texture patterns, other than dimpling, are contemplated.

Figure 5:
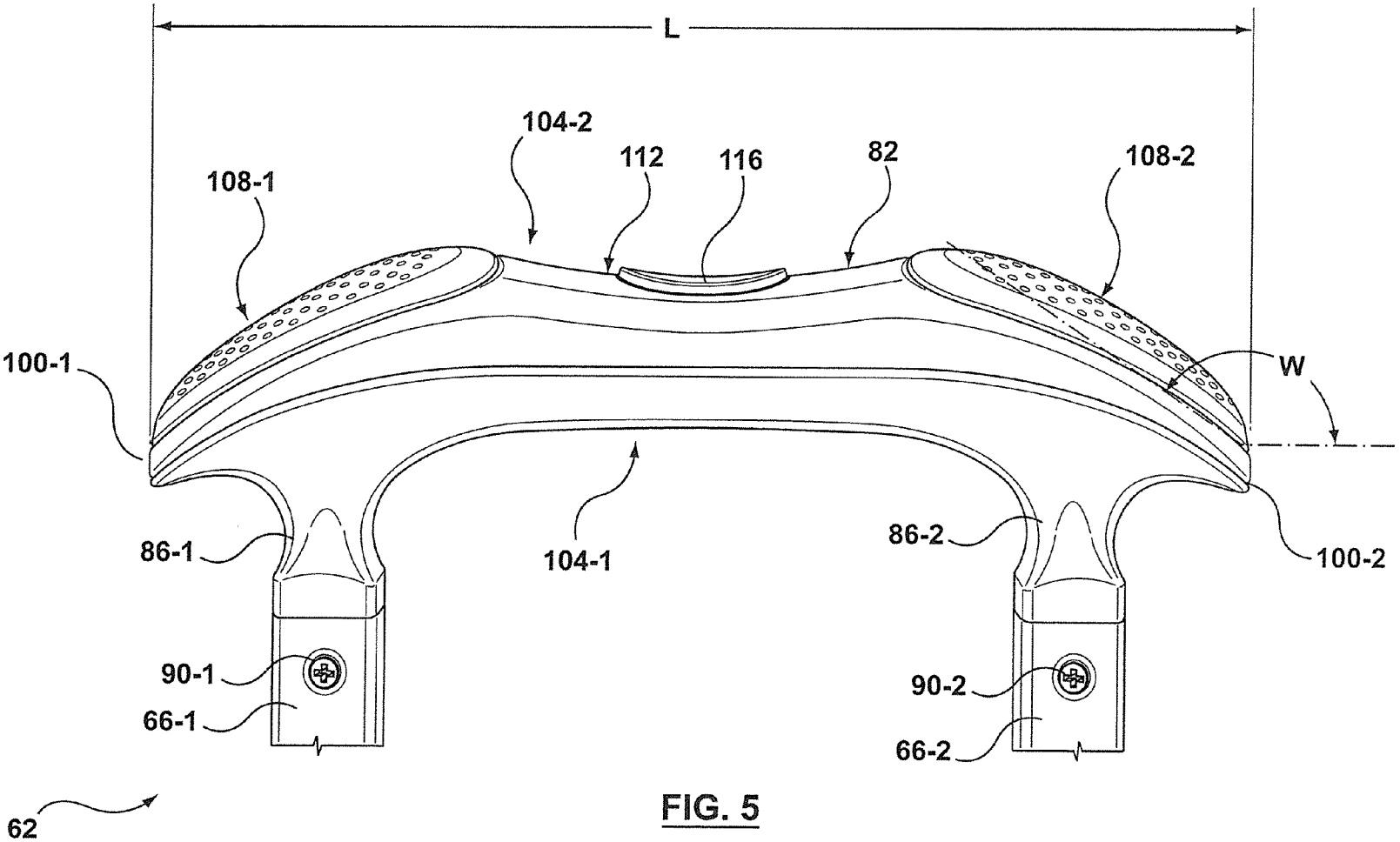
FIG. 5 shows a front planar view of the handle of FIG. 1.
Figure 6:
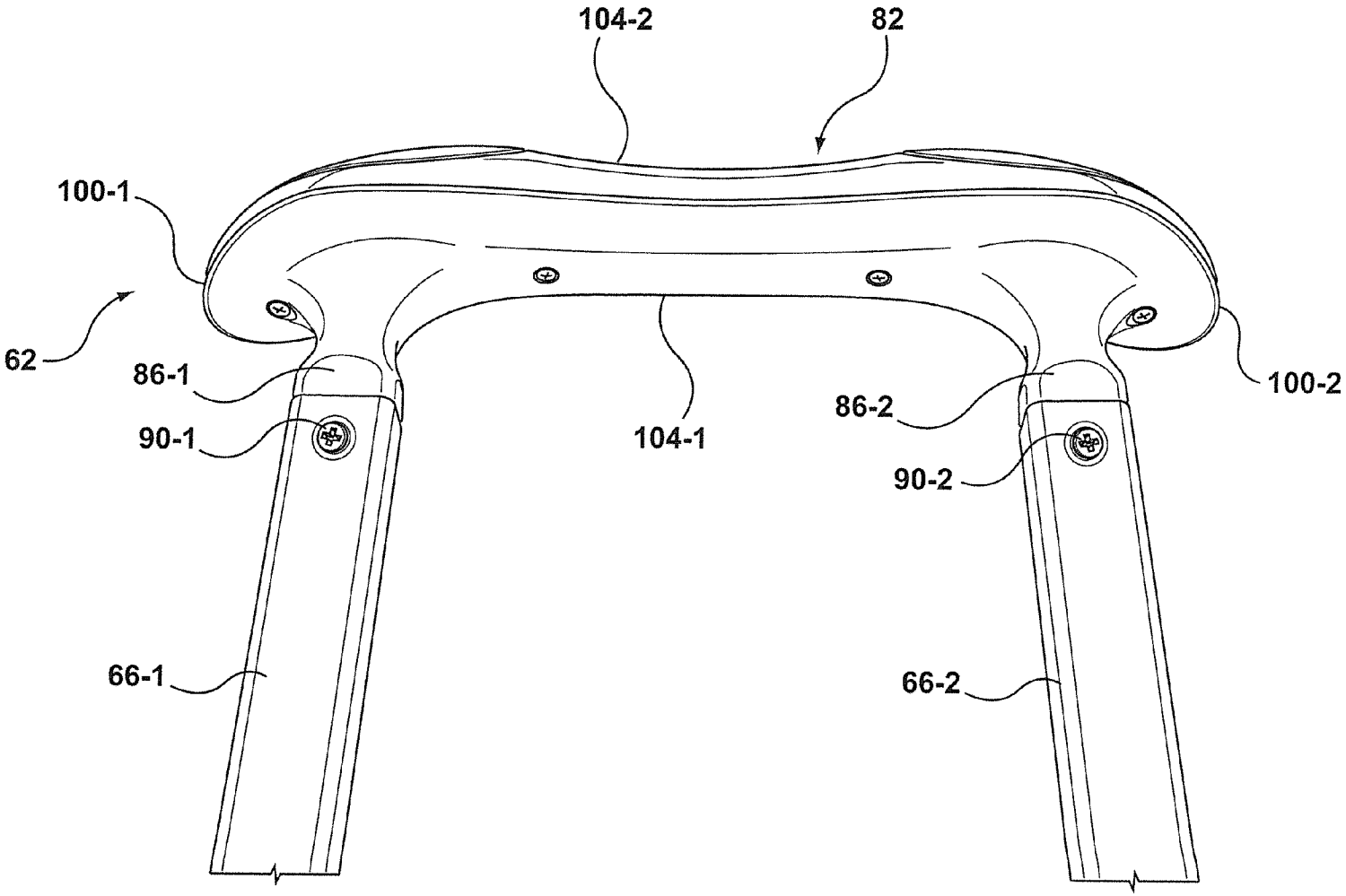
FIG. 6 shows a bottom perspective view of the handle of FIG. 1.
Figure 7:
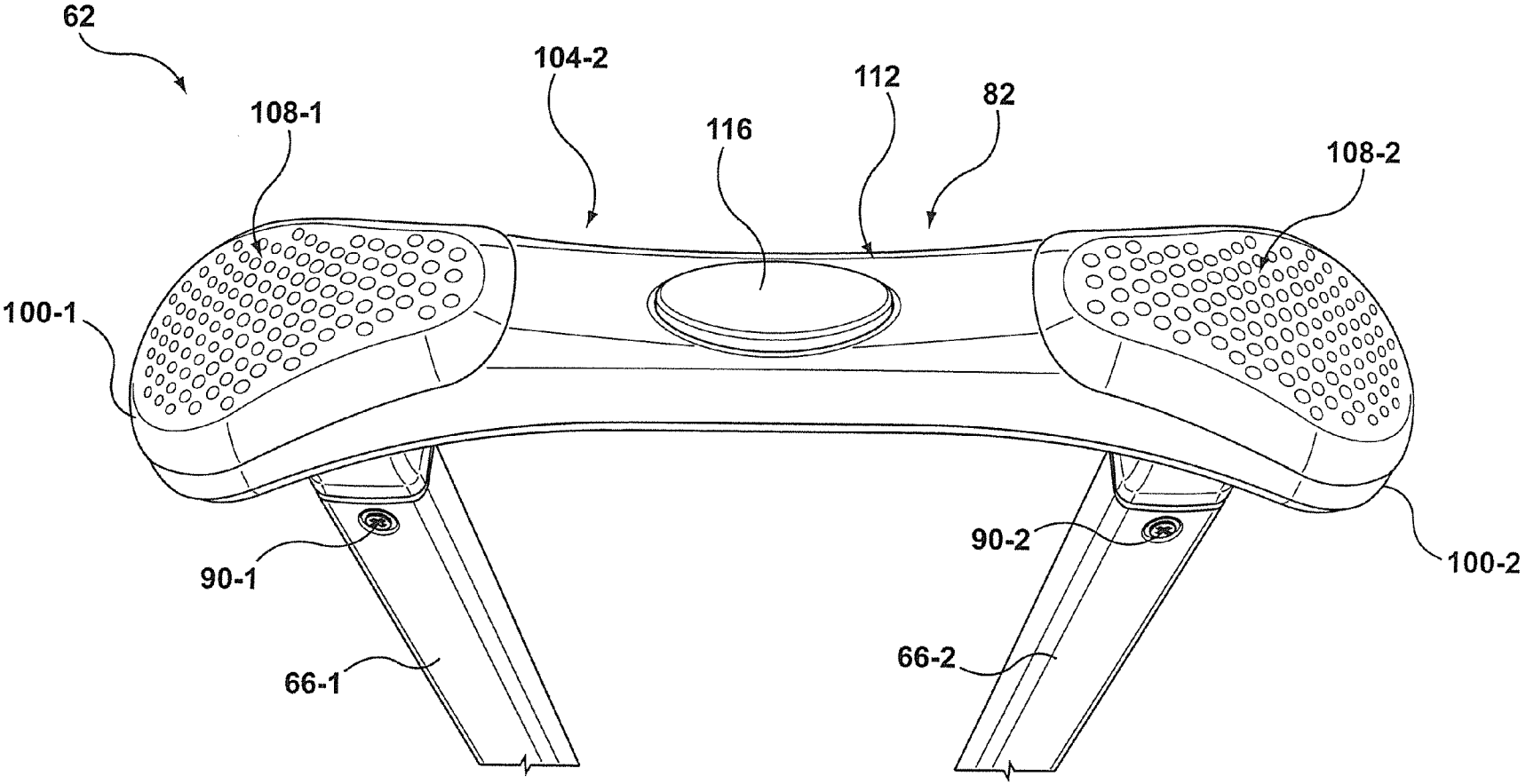
FIG. 7 shows a top perspective view of the handle of FIG. 1.

As best seen in FIG. 5, each palm grip 108 is also angled. In FIG. 5, an angle w is shown in relation to palm grip 108-2. Angle w defines an obtuse angle measured from a plane parallel to the length L of body 82. The actual length L is not particularly limited, and can be selected to accommodate various sizes of hands according to the teachings herein.

Angle w is chosen to complement a position for pushing luggage 50 that is well within a natural range of motion of the human wrist, so that the palm of the human hand can engage with a palm grip 108 without requiring an uncomfortable or otherwise unnatural bend in the human wrist. Angle w is thus greater than about ninety degrees but less than one-hundred-and-eighty-degrees. Angle w is presently preferred to be between about one-hundred-fifty-degrees and about one-hundred-and-ten-degrees. More specifically, angle w is presently preferred to be between about one-hundred-forty-five degrees and about one-hundred-and-twenty-degrees. More specifically, angle w is presently preferred to be between about one-hundred-forty-degrees and about one-hundred-and-thirty-degrees. More specifically, angle w is presently preferred to be about one-hundred-and-thirty-five-degrees.

As viewed in FIG. 8, central grip 112 is slightly convex along its outer edges, being slightly wider at its outer edges where central grip 112 joins with each palm grip 108. It should be understood, however, that central grip 112 can have different shapes, including having substantially the same width along its entire length. As viewed in FIG. 5, central grip is slightly concave along distal edge 104-2. An actuator 116 is disposed in the middle of central grip 112. Actuator 116 is biased towards a distal position which locks rods 66 in the extended position shown in FIG. 1 and FIG. 2. Actuator 116 may be depressed towards a position that is substantially contiguous with the surface of central grip 112, which unlocks rods 66 so that rods may be moved between the extended position and the retracted position shown in FIG. 3. Mechanical means are typically provided so that, upon release, actuator 116 is urged to the distal position and locks rods 66 in the retracted position shown in FIG. 3. Further mechanical means may also be provided so that handle 62 can be positioned, and locked, at one or more intermediate positions between the extended position shown in FIG. 1 and FIG. 2. It is presently preferred to provide at least one such intermediate position, to be discussed further below.

Figure 13:
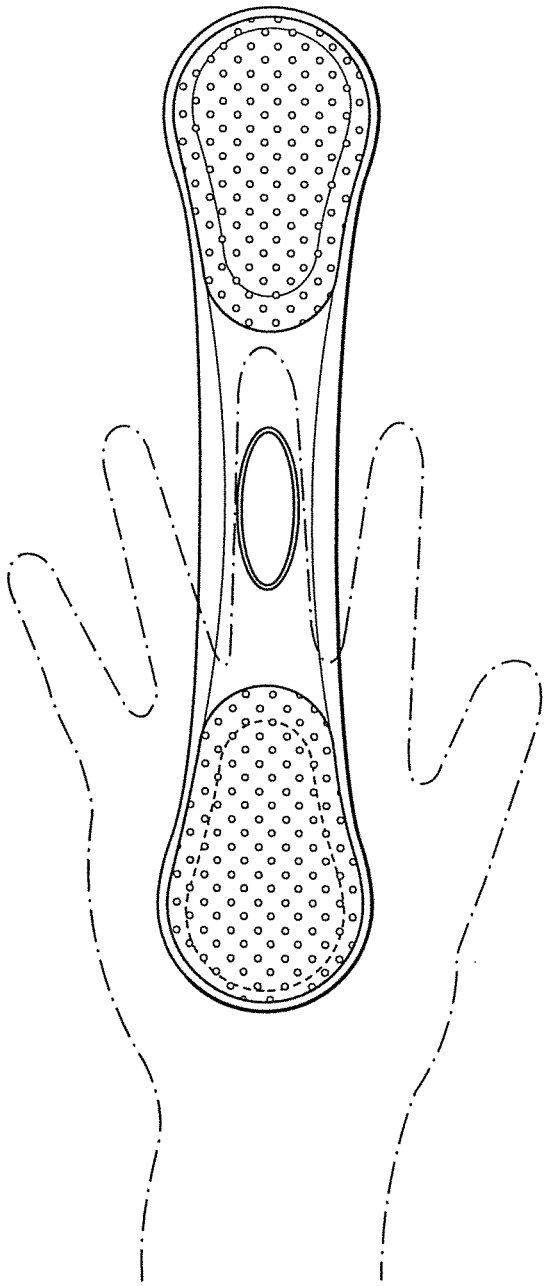
FIG. 13 shows the handle from the same view as FIG. 8 but with the outline of a human hand engaging with the handle.
Figure 14:
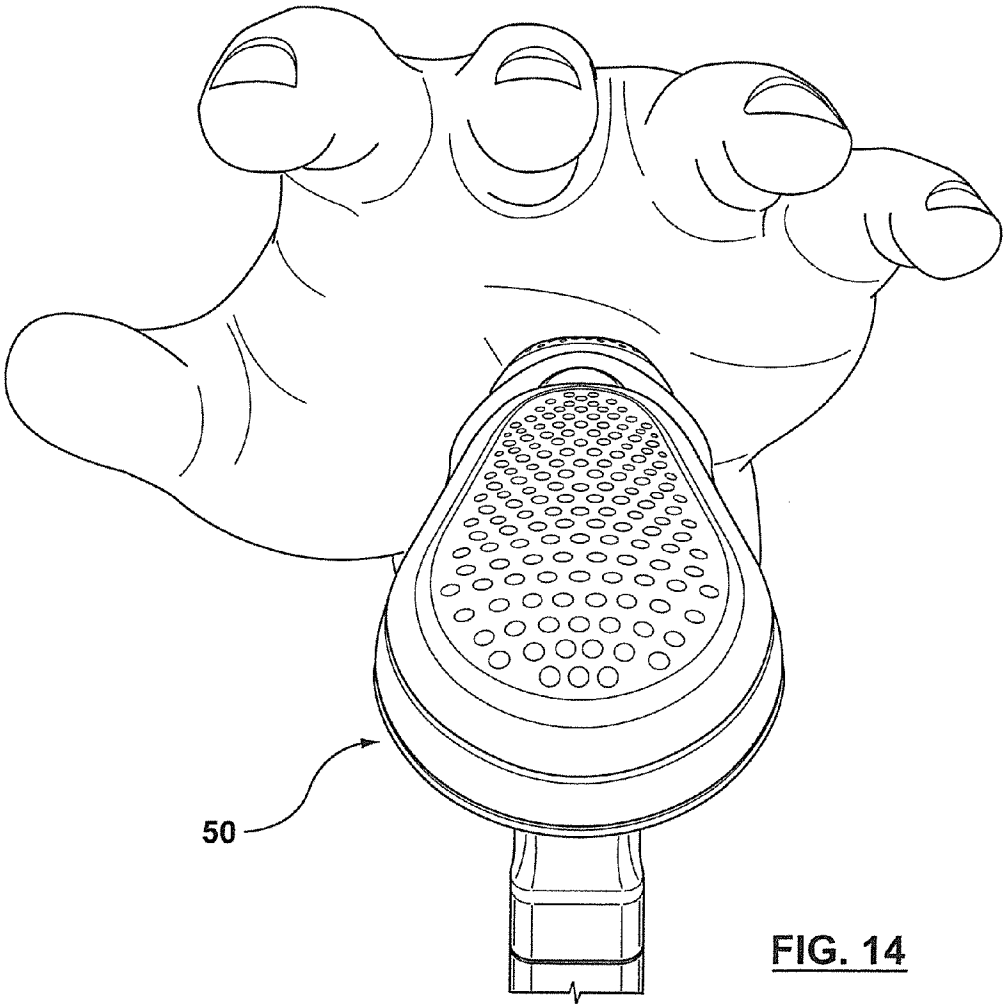
FIG. 14 shows a right view of the handle of FIG. 1 but with a human hand engaging with the handle.
Figure 15:
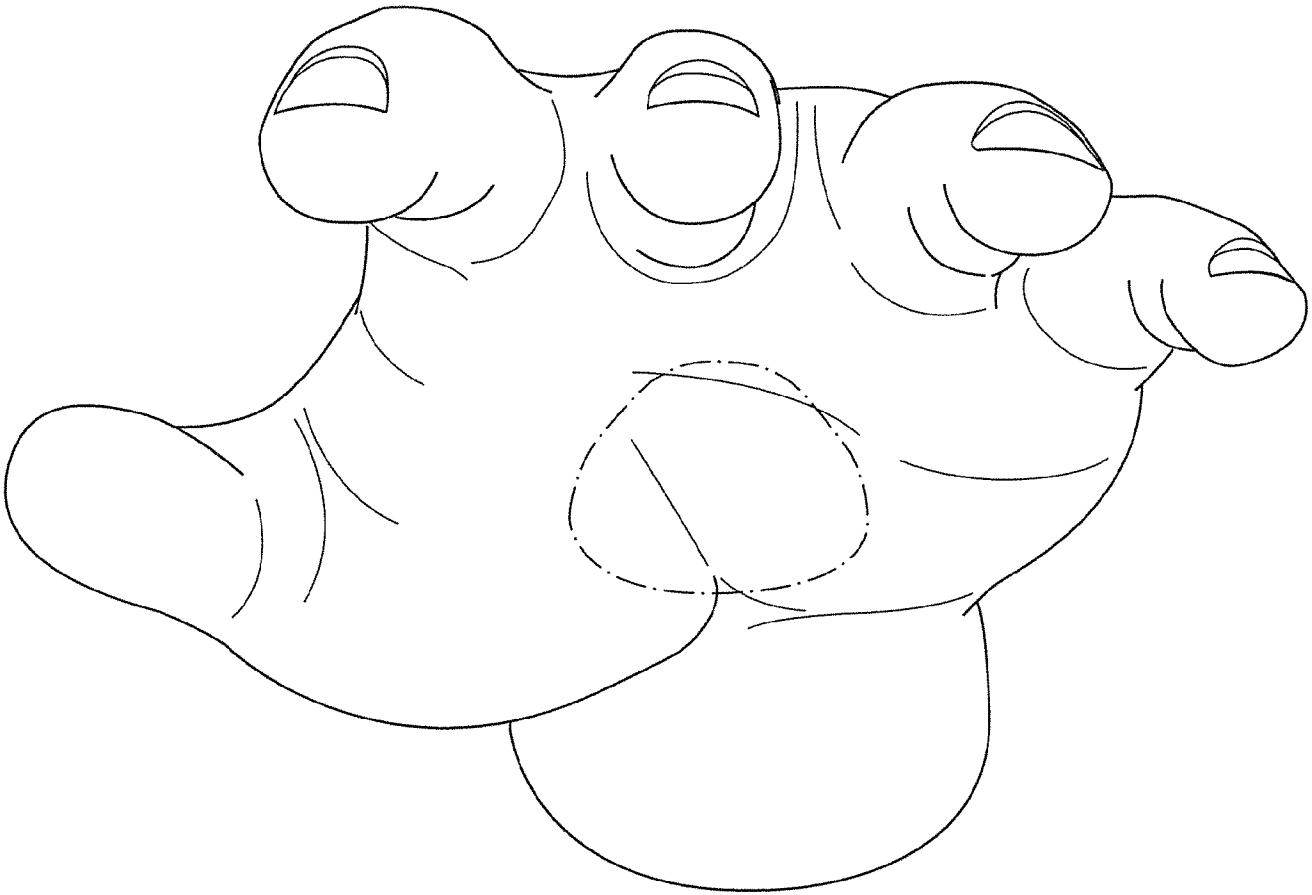
FIG. 15 shows the view of the human hand from FIG. 14 with a hashed-oval representing the area of contact between the handle and the palm.

FIG. 13, FIG. 14 and FIG. 15 shows the use of palm grips 108 in greater detail. FIG. 13 and FIG. 14 show example contact between the palm and a given palm grip 108. FIG. 15 shows an example of the area of contact by palm grip 108 on the palm. Of note is that the palm of a hand can contact substantially the entire surface of a palm grip 108. Also as noted is that, particularly when rods 66 are in the extended position shown in FIG. 1 and FIG. 2, the wrist can be angled comfortably while still contacting the surface of palm grip 108 and for pushing luggage 50.

Figure 16:
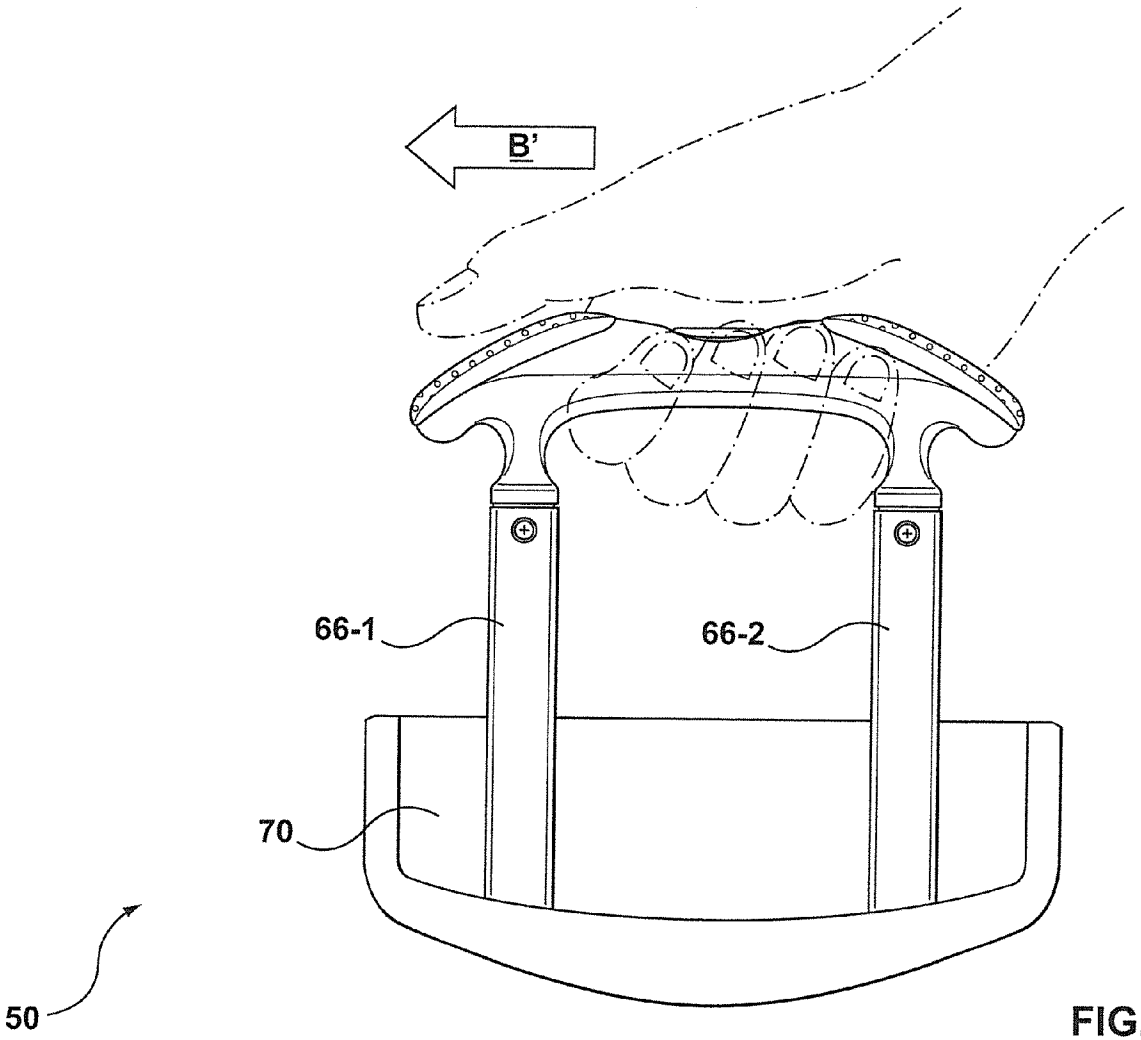
FIG. 16 shows the handle from the view of FIG. 3 with a human hand grasping the handle and pushing the handle in a first direction.
Figure 17:
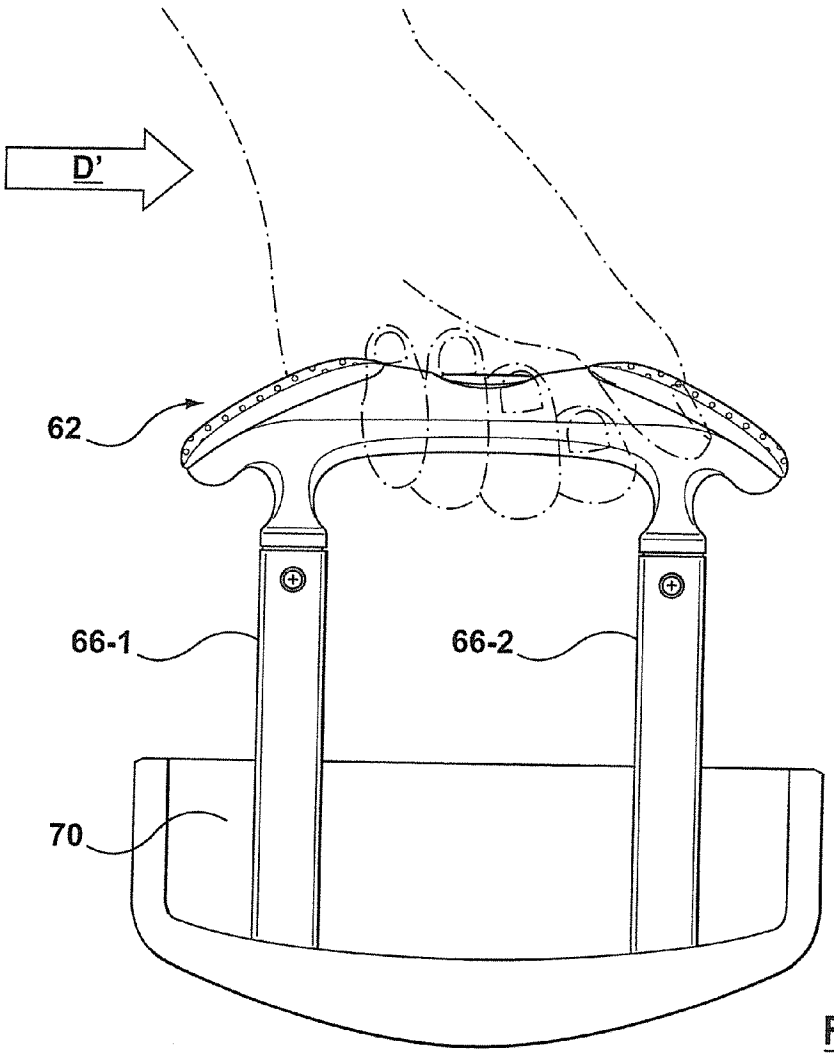
FIG. 17 shows the handle from the view of FIG. 16 with a human hand grasping the handle and pushing the handle in a second direction opposite from the direction in FIG. 16.

FIG. 16 and FIG. 17 show example use of central grip 112. The example in FIG. 16 and FIG. 17 contemplate the positioning of rods 66 at an intermediate position, lower than the extended position shown in FIG. 1 and FIG. 2, but higher than the retracted position. FIG. 16 and FIG. 17 demonstrate that central grip 112 may be comfortably grasped. FIG. 16 illustrates that palm grip 108-1 additionally provides a comfortable thumb rest and palm grip 108-2 providing padding for a portion of the palm. In FIG. 16, a force in the direction of arrow B' can be applied while walking to roll luggage 50. The direction in FIG. 16 is roughly analogous to the direction of movement shown in FIG. 1. In FIG. 17, a force in the direction of arrow D' can be applied while walking to roll luggage 50. The direction in FIG. 17 is roughly analogous to the direction of movement shown in FIG. 2.

Figure 18:
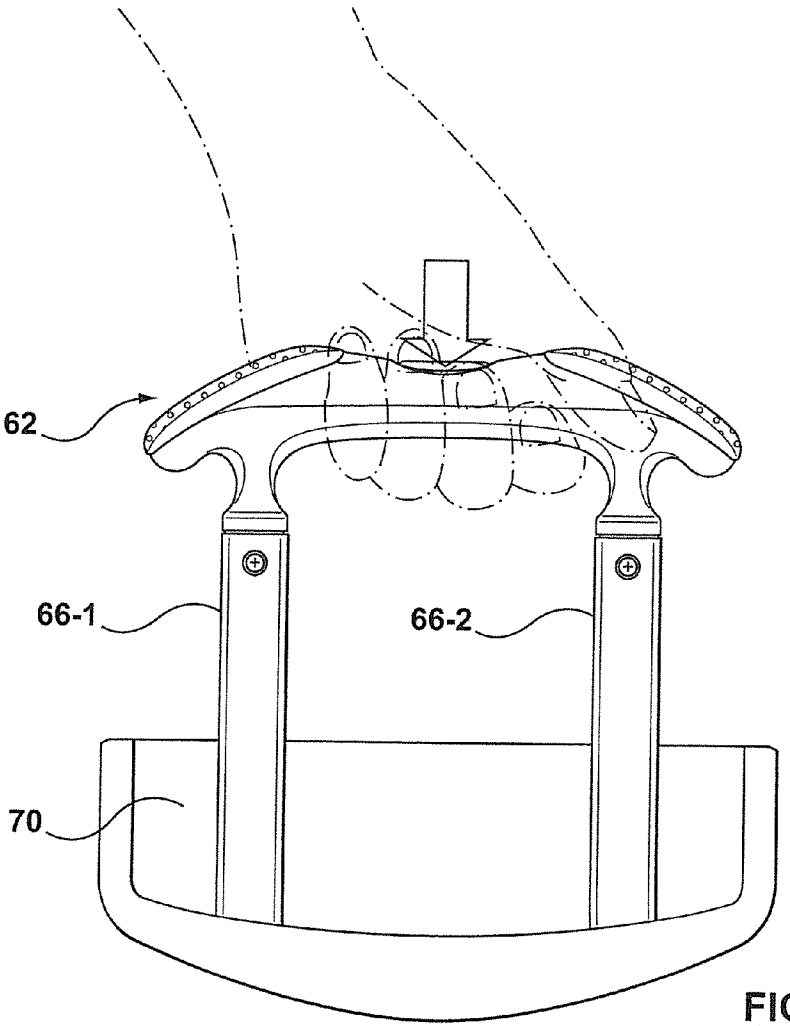
FIG. 18 shows the handle from the view of FIG. 18 with a human hand grasping the handle and depressing an actuator button on the handle.
Figure 19:
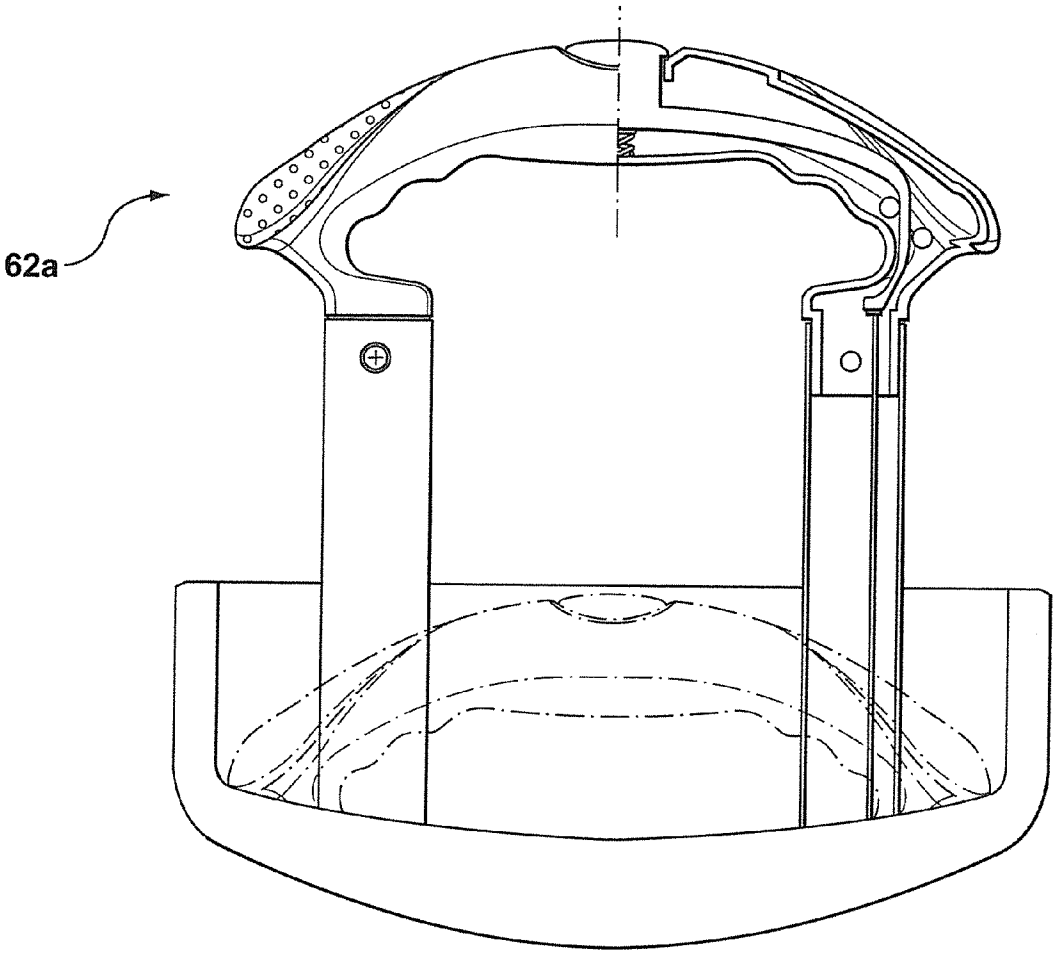
FIG. 19 is a front planar view of a first alternative configuration of the handle of FIG. 1.
Figure 20:
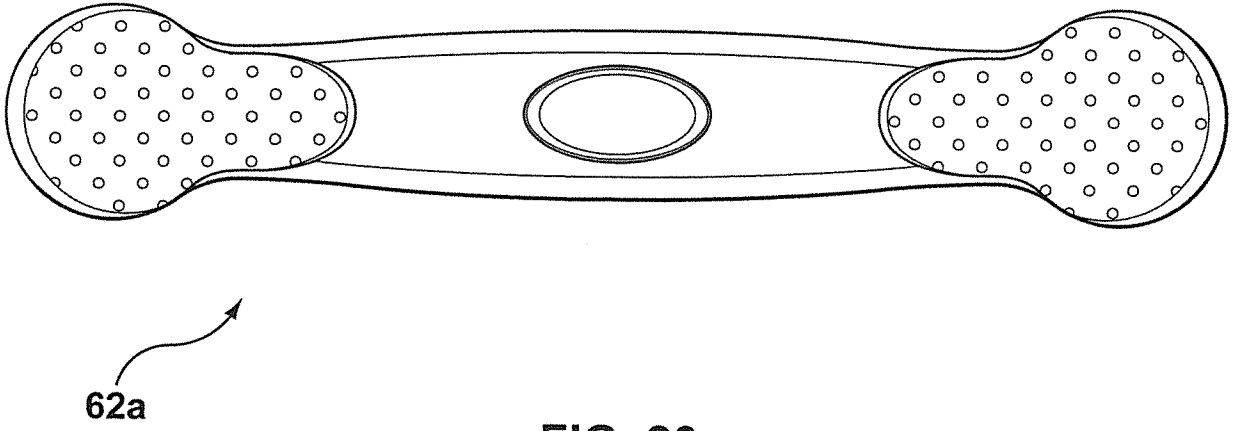
FIG. 20 is a top view of the handle of FIG. 19.
Figure 21:
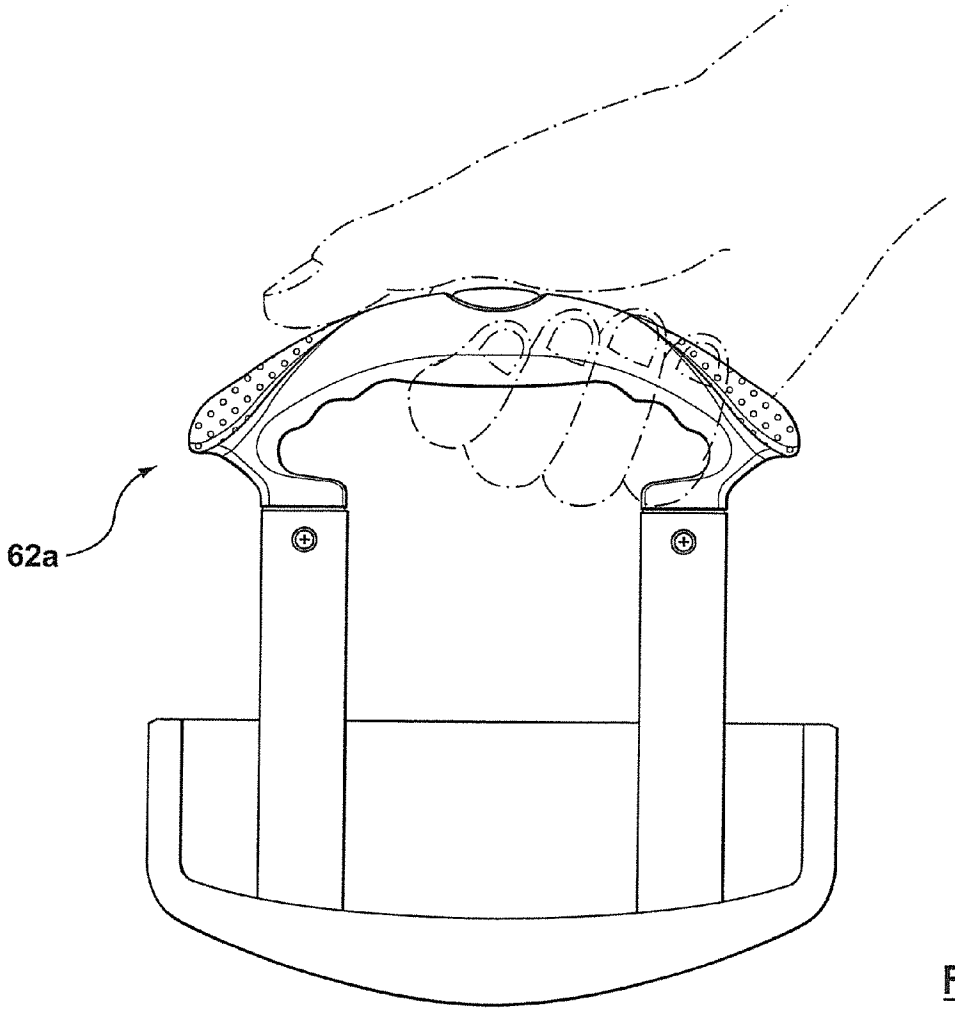
FIG. 21 shows the handle of FIG. 19 with a human hand grasping the handle and pushing the handle.
Figure 22:
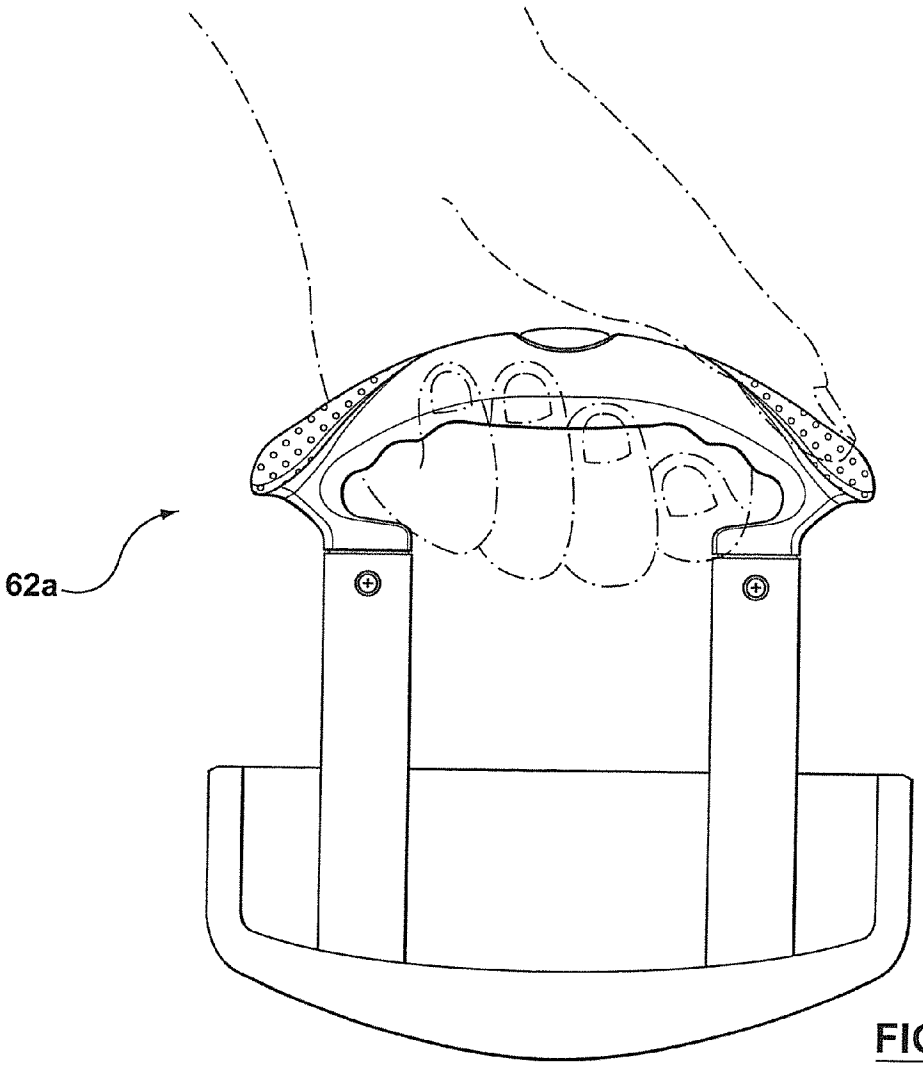
FIG. 22 shows the handle of FIG. 21 with a human hand grasping the handle and depressing the actuator button on the handle.
Figure 23:
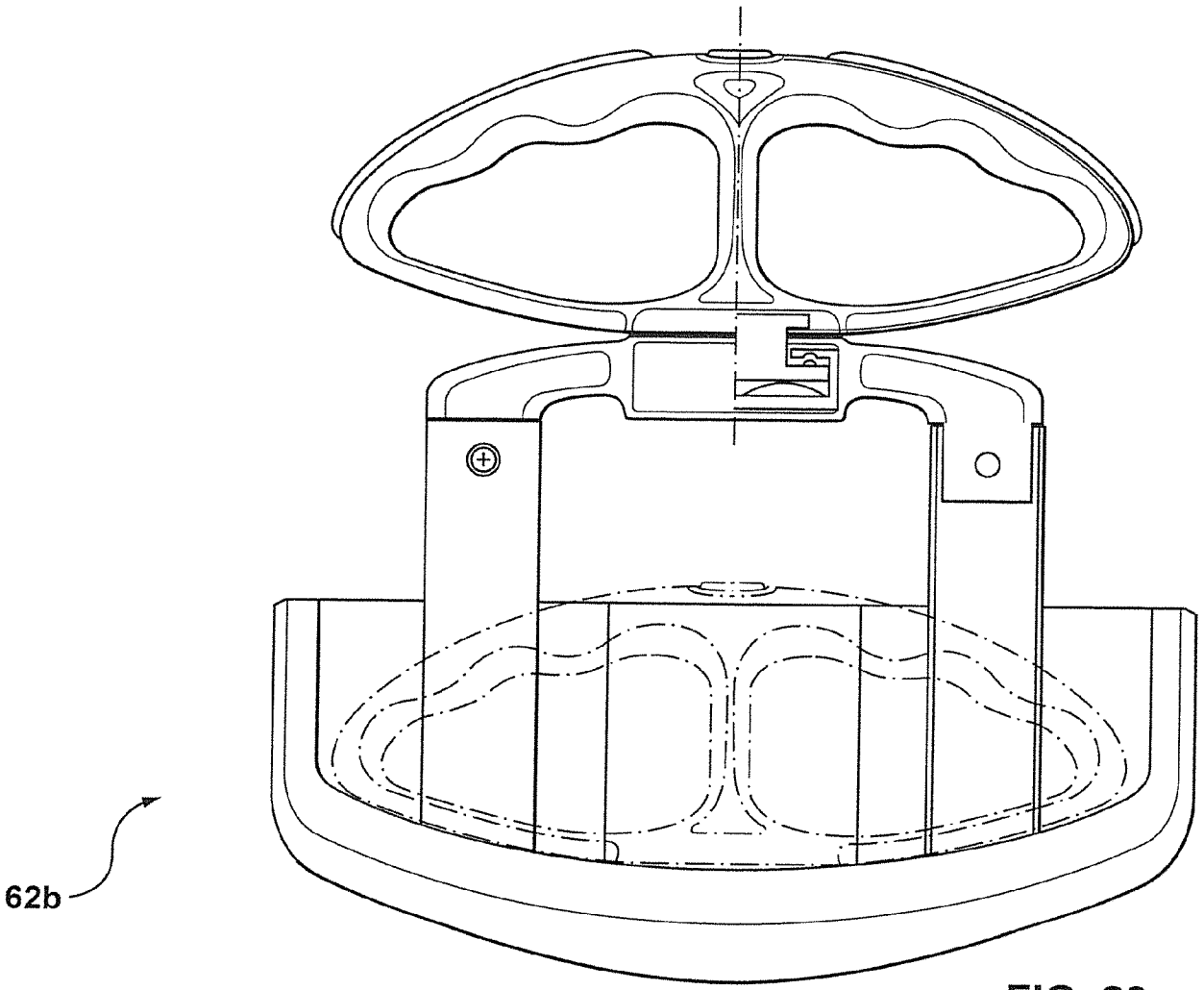
FIG. 23 is a front planar view of a second alternative configuration of the handle of FIG. 1.
Figure 24:
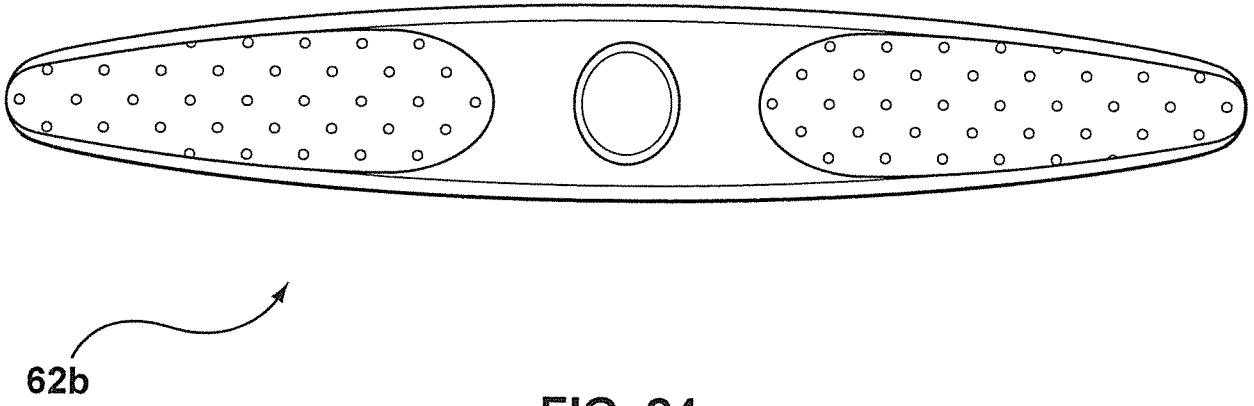
FIG. 24 is a top view of the handle of FIG. 23.

FIG. 18 shows further example use of central grip 112, whereby central grip is squeezed to accomplish depression of actuator 116 to unlock rods 66 and facilitate their movement between the extended position or the retracted position.

While not shown, the grasping of handle 62 in FIG. 18 can also be used to apply a lifting or pulling force on handle 62.

Variations, subsets, enhancements and combinations of the foregoing are contemplated. For example, FIG. 19, FIG. 20, FIG. 21, and FIG. 22 show a first alternative handle 62*a*, which is a variation on handle 62. Handle 62*a* has slightly different shape but includes palm grips 108, while omitting the concavity of central grip 112.

Figure 25:
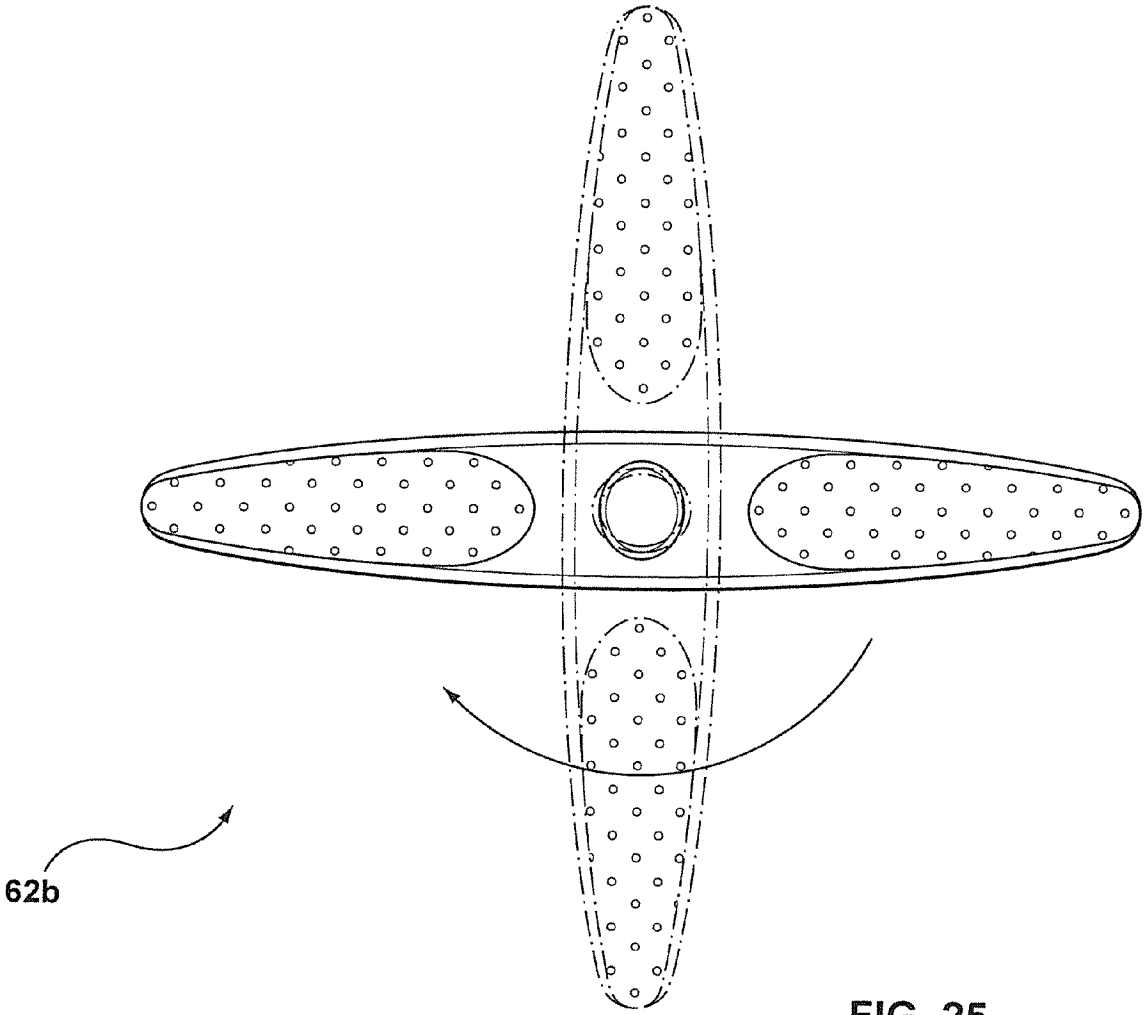
FIG. 25 shows the top view of the handle of FIG. 24 including angles of possible rotation.
Figure 26:
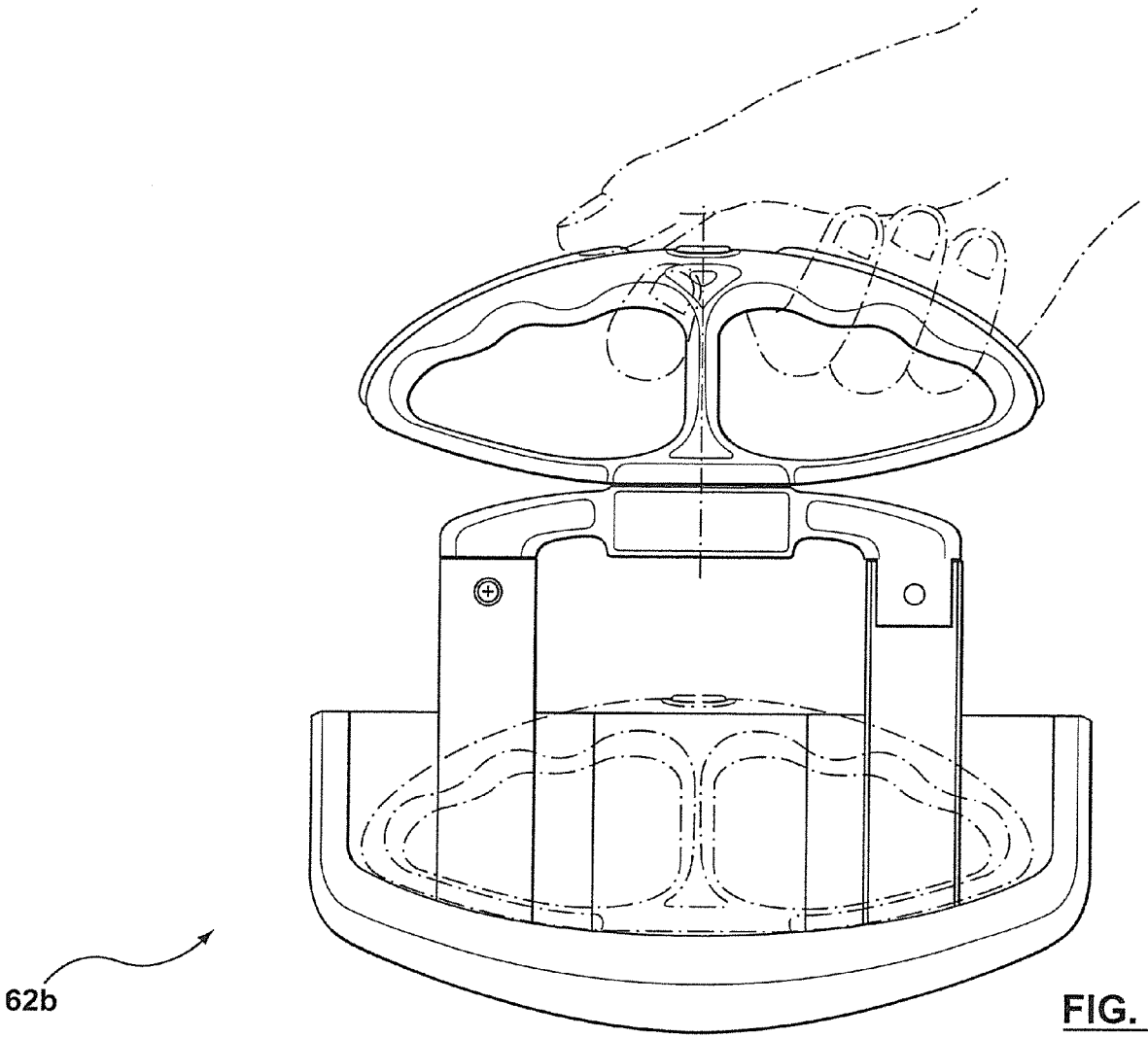
FIG. 26 shows the handle of FIG. 25 with a human hand grasping the handle.
Figure 27:
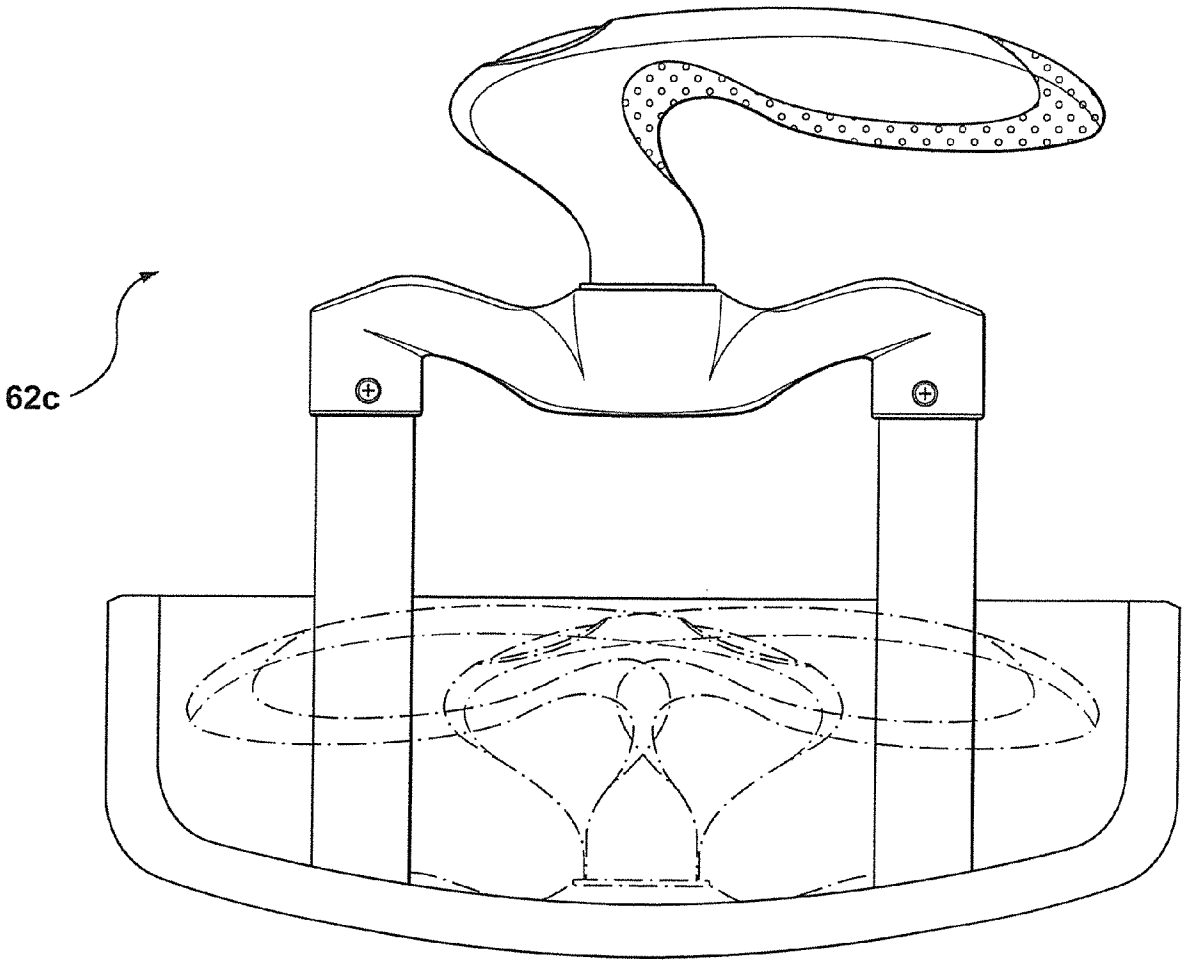
FIG. 27 is a front planar view of a third alternative configuration of the handle of FIG. 1.
Figure 28:
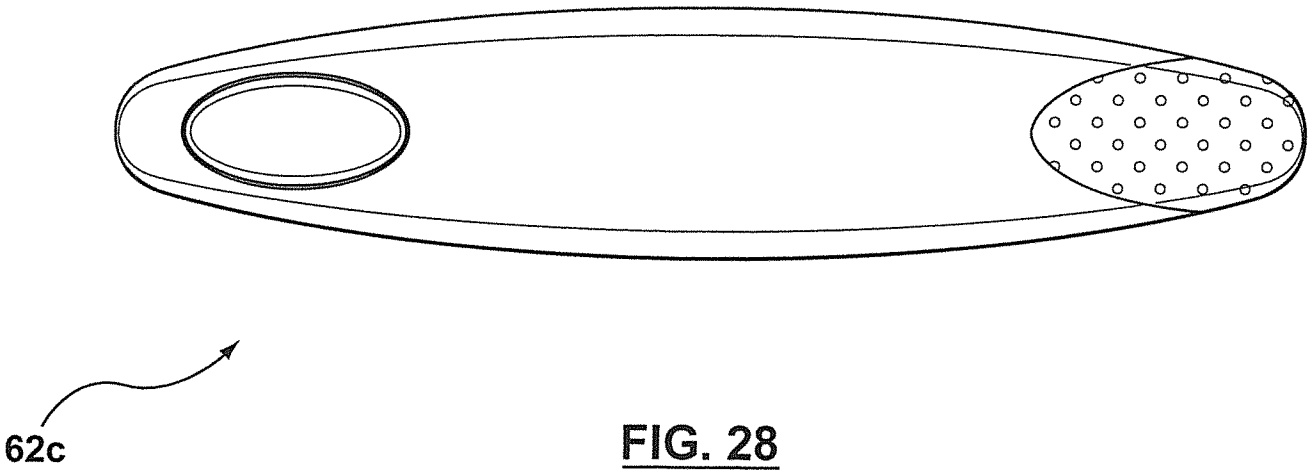
FIG. 28 is a top view of the handle of FIG. 27.

FIG. 23, FIG. 24, FIG. 25 and FIG. 26 show a second alternative handle 62*b*. Handle 62*b* also omits the concavity of central grip 112 and is rotatable, as shown in FIG. 25, by ninety degrees to provide a different grasping angle for the wrist.

Figure 29:
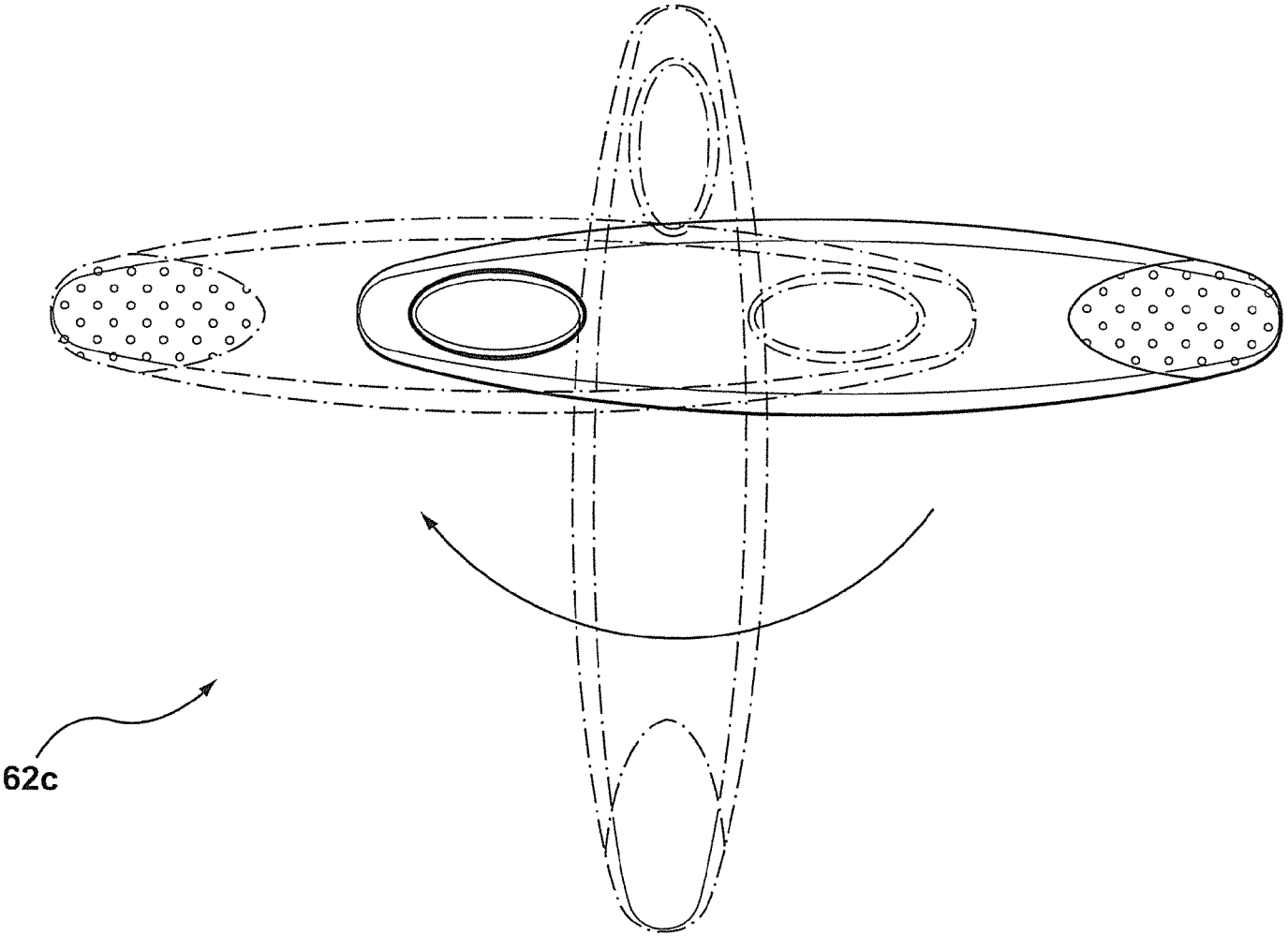
FIG. 29 shows the top view of the handle of FIG. 24 including angles of possible rotation.
Figure 30:
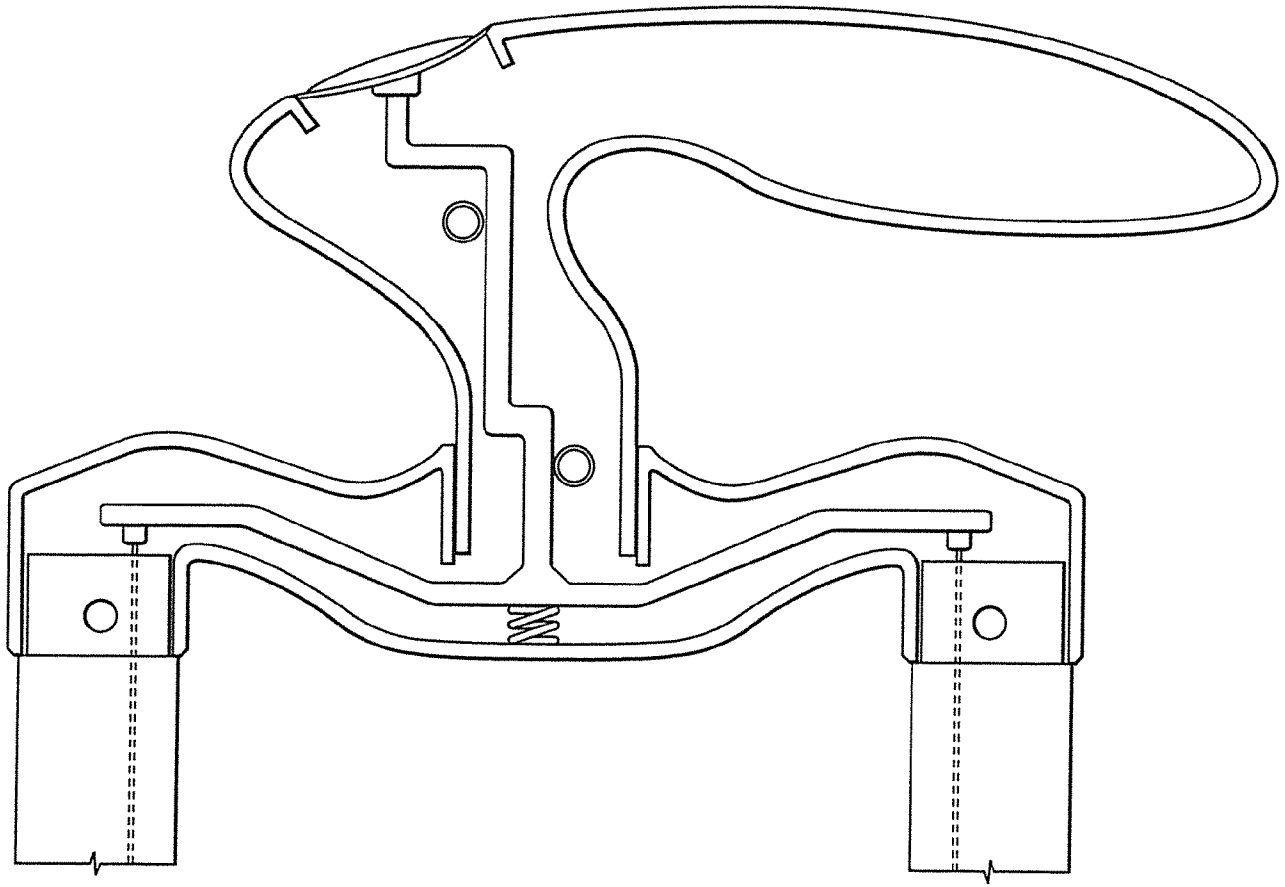
FIG. 30 is a front sectional view of the third alternative configuration showing the mechanical workings of the actuator.
Figure 31:
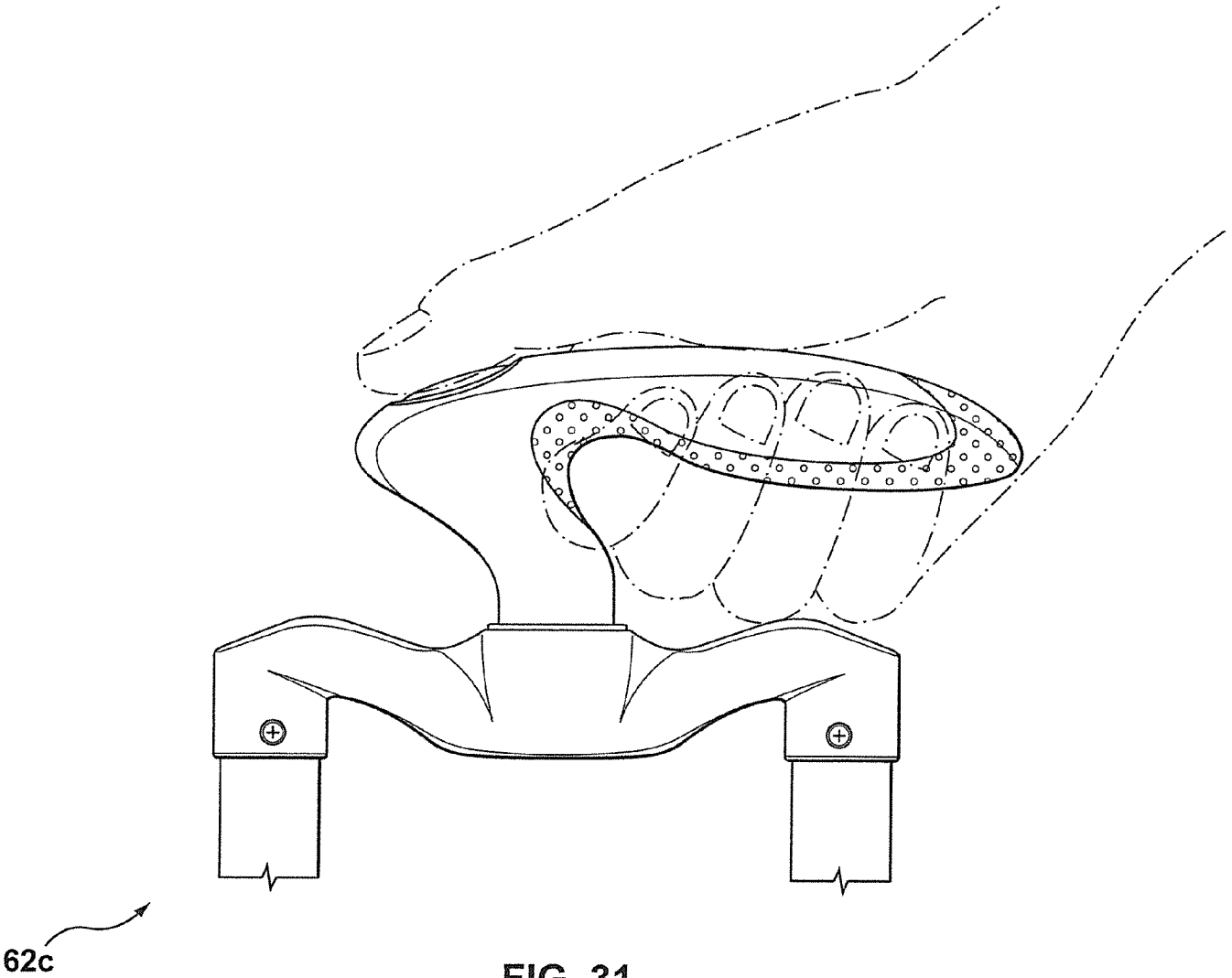
FIG. 31 shows the handle of FIG. 27 with a human hand grasping the handle.
Figure 32:
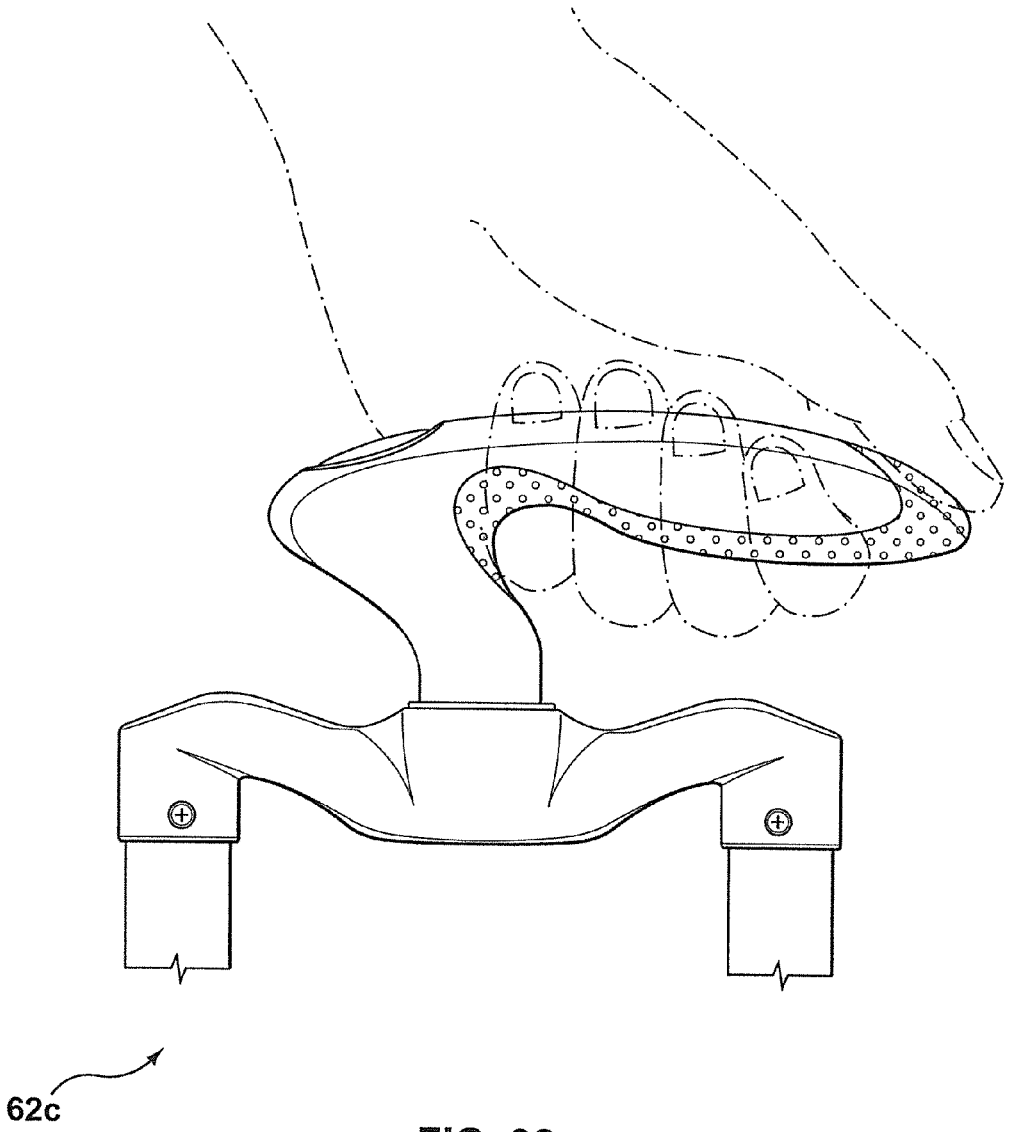
FIG. 32 shows an alternative grasping of the handle shown in FIG. 31.
Figure 33:
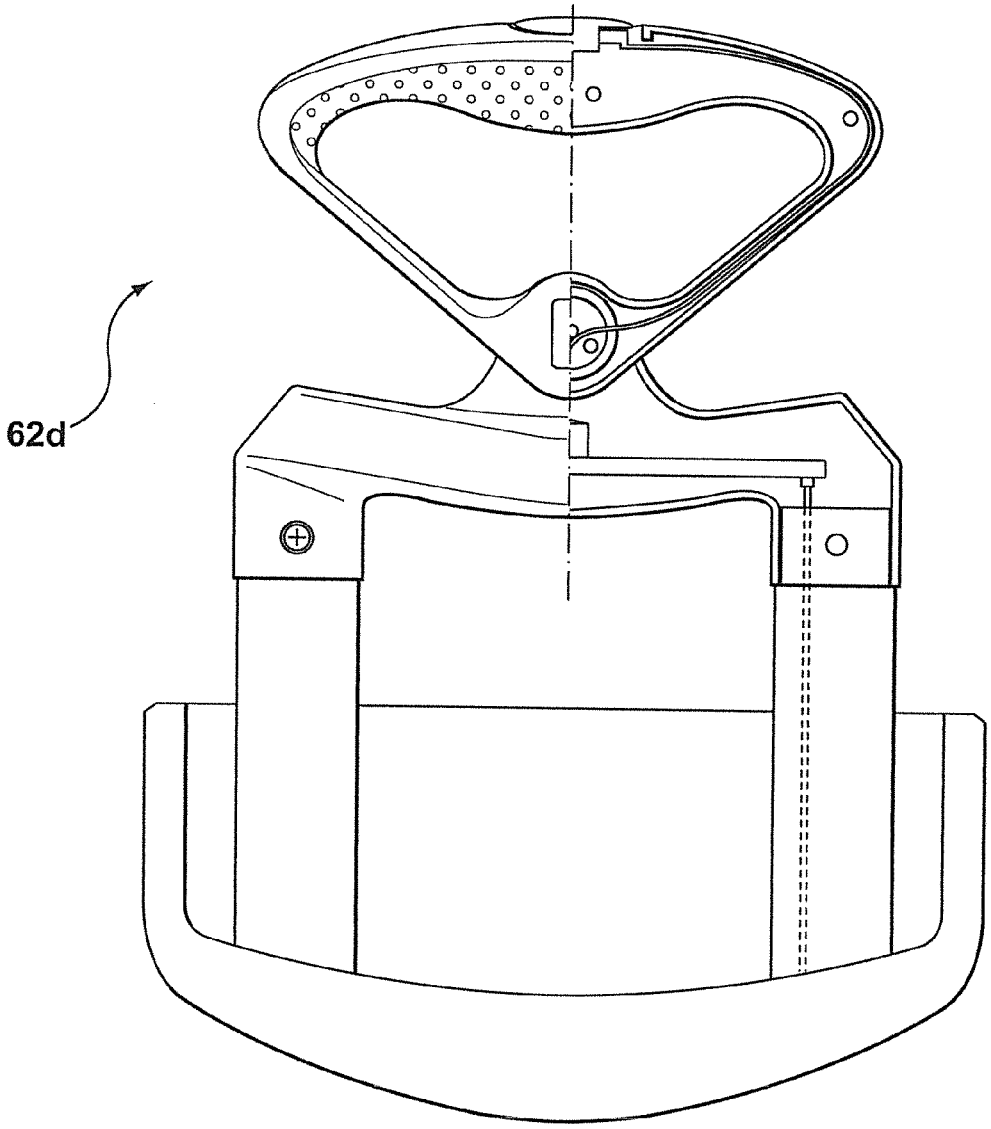
FIG. 33 is a front planar view of a fourth alternative configuration of the handle of FIG. 1.
Figure 34:
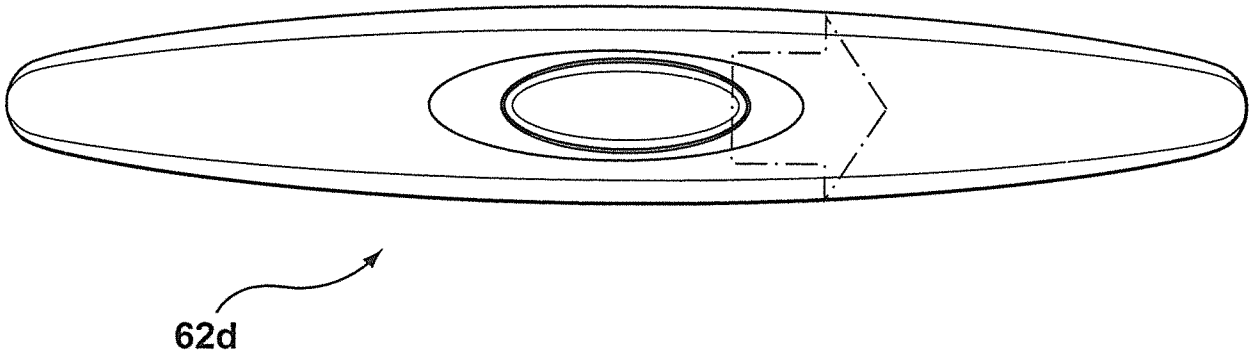
FIG. 34 shows the top view of the handle of FIG. 33.
Figure 35:
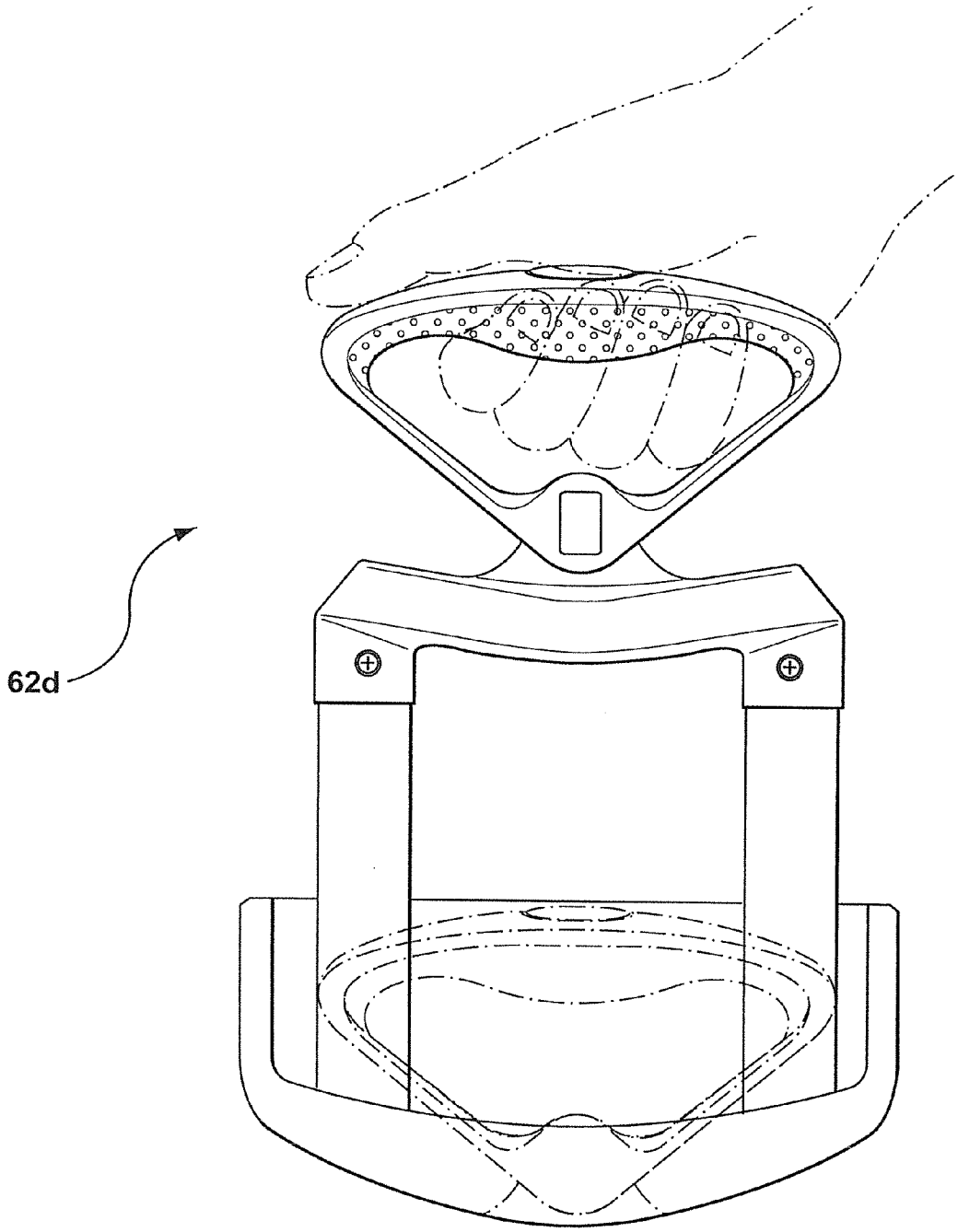
FIG. 35 shows the handle of FIG. 33 with a human hand grasping the handle.
Figure 36:
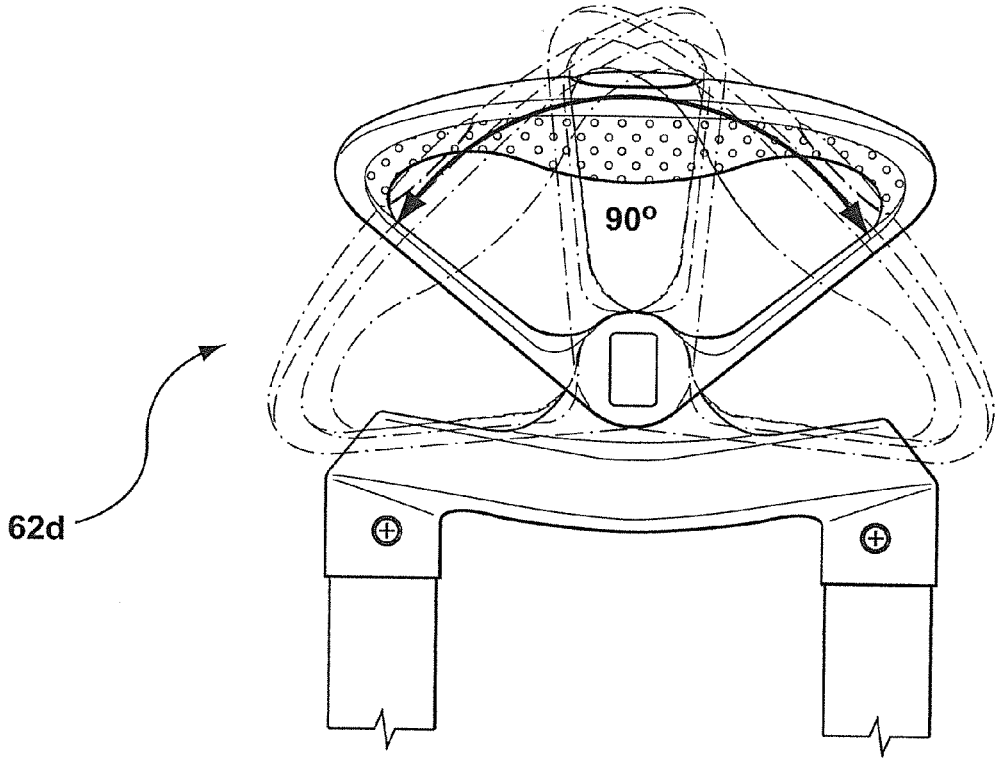
FIG. 36 shows the handle of FIG. 33 including angles of possible rotation.

FIG. 27, FIG. 28, FIG. 29, FIG. 30, FIG. 31 and FIG. 32 show a third alternative handle 62*c*. Like handle 62*b*, handle 62*c* is also rotatable, as shown in FIG. 29, by ninety degrees, and to a full one-hundred-and-eighty-degrees to provide a different grasping angles for the wrist.

FIG. 33, FIG. 34, FIG. 35 and FIG. 36 shows a fourth alternative handle 62*d*. Handle 62*d* is pivotable about an axis that is perpendicular to rods 66 to thereby provide different ergonomic angles for grasping.

In a still further variation, not shown, handle 62 may be implemented so as to have a partially spheroidal shape (i.e. akin to a section of a sphere) so that handle 62 can be pushed ergonomically from any direction.

The invention claimed is:

1. A handle for luggage comprising:

a body having a first end and a second end opposite said first end, said body connectable to at least one rod; said rod connecting said handle to a compartment, said compartment comprising a plurality of wheels orientable in a first direction and a second direction, said plurality of wheels configured to roll said luggage along said first direction in response to a first applied pushing force, said plurality of wheels configured to roll said luggage along said second direction in response to a second applied pushing force;

a first palm grip disposed at said first end of said body, said first palm grip configured to receive said first applied pushing force from a palm of a hand;

a second palm grip disposed at said second end of said body, said second palm grip configured to receive said second applied pushing force from said palm of said hand; and a central portion between said first palm grip and said second palm grip, wherein each of said first palm grip and said second palm grip is substantially tear-drop shaped having a wider bulbous portion proximal to its respective end and a narrow bulbous portion proximal said central portion, wherein each of said first palm grip and said second palm grip includes a contact surface for providing substantially contiguous contact with at least a portion of said palm, said first palm grip configured to receive said first applied pushing force from said palm for pushing said luggage and configured to distribute said applied force across an area of said palm, said second palm grip configured to receive said second applied pushing force from said palm for pushing said luggage and configured to distribute said second applied pushing force across an area of said palm.

2. The handle of claim 1 wherein said plurality of wheels are spinner wheels that are rotatable about an axis substantially normal to a rolling surface.

3. The handle of claim 1 wherein said central portion is substantially concave.

4. The handle of claim 1 wherein said central portion comprises an actuator for releasing said at least one rod to make moveable said at least one rod between an extended position distal from said compartment and a retracted position proximal to said compartment.

5. The handle of claim 1 wherein said first palm grip and said second palm grip are substantially convex.

6. The handle of claim 1 wherein said contact surface of each of said first palm grip and said second palm grip includes a frictional surface configured to increase the frictional force between said contact surface and said palm.

7. The handle of claim 6 wherein said frictional surface comprises a textured pattern.

8. The handle of claim 6 wherein said frictional surface comprises a resiliently-deformable material, said resiliently-deformable material configured to improve distribution of force across said area of said palm that comes into contact with said palm grip.

9. The handle of claim 1 wherein each of said palm grips is configured to receive one of said first applied pushing force and said second applied pushing force when each wheel of said plurality of wheels is in contact with a surface.

10. An article of luggage comprising:

a compartment, said compartment comprising a plurality of wheels orientable in a first direction and a second direction, wherein said plurality of wheels are spinner wheels that are rotatable about an axis substantially normal to a rolling surface, said plurality of wheels configured to roll said article along said first direction in response to a first applied pushing force, said plurality of wheels configured to roll said article along said second direction in response to a second applied pushing force;

at least one rod extendable from said compartment;

a handle body having a first end and a second end opposite said first end, said handle body connected to said at least one rod;

a first palm grip disposed at said first end of said handle body, said first palm grip configured to receive said first applied pushing force from a palm of a hand; and a second palm grip disposed at said second end of said handle body, said second palm grip configured to receive said second applied pushing force from said palm of said hand, wherein said handle body includes a central portion located between said first palm grip and said second palm grip, wherein each of said first palm grip and said second palm grip is substantially tear-drop shaped having a wider bulbous portion proximal to its respective end and a narrow bulbous portion proximal said central portion, wherein each of said first palm grip and said second palm grip includes a contact surface for providing substantially contiguous contact with at least a portion of said palm, said first palm grip configured to receive said first applied pushing force from said palm for pushing said article and configured to distribute said applied force across an area of said palm, said second palm grip configured to receive said second applied pushing force from said palm for pushing said article and configured to distribute said second applied pushing force across an area of said palm.

11. The article of claim 10 wherein said contact surface of each of said first palm grip and said second palm grip includes a frictional surface configured to increase a frictional force between said contact surface and said palm.

12. The article of claim 11 wherein said frictional surface comprises a textured pattern.

13. The article of claim 11 wherein said frictional surface comprises a resiliently-deformable material, said resiliently-deformable material configured to improve distribution of force across said area of said palm that comes into contact with said palm grip.

14. The article of claim 11 wherein each of said palms grip is configured to receive one of said first applied pushing force and said second applied pushing force when each wheel of said plurality of wheels is in contact with a surface.

15. A handle for luggage comprising:

a body having a first end and a second end opposite said first end, said body connectable to at least one rod; said rod connecting said handle to a compartment, said compartment comprising a plurality of wheels orientable in a first direction and a second direction, said plurality of wheels configured to roll said luggage along said first direction in response to a first applied pushing force, said plurality of wheels configured to roll said luggage along said second direction in response to a second applied pushing force;

a first palm grip disposed at said first end of said body, said first palm grip comprising a frictional surface configured to increase friction with a palm of a hand; and a second palm grip disposed at said second end of said body, said second palm grip comprising a frictional surface configured to increase friction with said palm of said hand, wherein each of said first palm grip and said second palm grip is substantially tear-drop shaped having a wider bulbous portion proximal to its respective end and a narrow bulbous portion proximal said central portion, wherein the frictional surfaces each of said first palm grip and said second palm grip provides substantially contiguous contact with at least a portion of said palm, said frictional surface of said first palm grip configured to receive said first applied pushing force from said palm for pushing said luggage and configured to distribute said applied force across an area of said palm, said frictional surface of said second palm grip configured to receive said second applied pushing force from said palm for pushing said luggage and configured to distribute said second applied pushing force across an area of said palm.

16. The handle of claim 15 wherein said frictional surface comprises a textured pattern.

17. The handle of claim 15 wherein said frictional surface comprises a resiliently-deformable material, said resiliently-deformable material configured to improve distribution of force across said area of said palm that comes into contact with said palm grip.

18. The handle of claim 15 wherein said plurality of wheels are spinner wheels that are rotatable about an axis substantially normal to a rolling surface.

* * * * *